US007878765B2

(12) United States Patent
Gonnella et al.

(10) Patent No.: US 7,878,765 B2
(45) **Date of Patent: *Feb. 1, 2011**

(54) SYSTEM AND METHOD FOR MONITORING OPERATION OF A PUMP

(75) Inventors: George Gonnella, Pepperell, MA (US); James Cedrone, Braintree, MA (US)

(73) Assignee: Entegris, Inc., Billerica, MA (US)

( * ) Notice: Subject to any disclaimer, the term of this patent is extended or adjusted under 35 U.S.C. 154(b) by 730 days.

This patent is subject to a terminal disclaimer.

(21) Appl. No.: 11/364,286

(22) Filed: Feb. 28, 2006

(65) Prior Publication Data

US 2007/0128047 A1 Jun. 7, 2007

Related U.S. Application Data

(63) Continuation-in-part of application No. 11/292,559, filed on Dec. 2, 2005.

(51) Int. Cl.
*F04B 49/06* (2006.01)

(52) U.S. Cl. ..... 417/44.2; 417/2

(58) Field of Classification Search ..... 417/2, 417/53, 44.2; 702/138–140, 145, 182–185
See application file for complete search history.

(56) References Cited

U.S. PATENT DOCUMENTS

| | | | |
|---|---|---|---|
| 269,626 | A | 12/1882 | Bodel et al. |
| 826,018 | A | 7/1906 | Concoff |
| 1,664,125 | A | 3/1928 | Lowrey |
| 2,153,664 | A | 4/1939 | Freedlander |
| 2,215,505 | A | 9/1940 | Hollander |
| 2,328,468 | A | 8/1943 | Laffly |
| 2,457,384 | A | 12/1948 | Krenz |
| 2,631,538 | A | 3/1953 | Johnson |
| 2,673,522 | A | 3/1954 | Dickey |
| 2,757,966 | A | 8/1956 | Samiran |
| 3,227,279 | A | 1/1966 | Bockelman |

(Continued)

FOREIGN PATENT DOCUMENTS

| | | |
|---|---|---|
| AU | 78872/87 | 4/1988 |

(Continued)

OTHER PUBLICATIONS

International Search Report and Written Opinion issued in PCT/US07/05377 mailed Jun. 4, 2008.

(Continued)

*Primary Examiner*—Michael Cuff
*Assistant Examiner*—Dnyanesh Kasture
(74) *Attorney, Agent, or Firm*—Sprinkle IP Law Group

(57) ABSTRACT

Systems and methods for monitoring operation of a pump, including verifying operation or actions of a pump, are disclosed. A baseline profile for one or more parameters of a pump may be established. An operating profile may then be created by recording one or more values for the same set of parameters during subsequent operation of the pump. The values of the baseline profile and the operating profile may then be compared at one or more points or sets of points. If the operating profile differs from the baseline profile by more than a certain tolerance an alarm may be sent or another action taken, for example the pumping system may shut down, etc.

20 Claims, 15 Drawing Sheets

U.S. PATENT DOCUMENTS 3,327,635 A 6/1967 Sachnik
3,623,661 A 11/1971 Wagner
3,741,298 A 6/1973 Canton
3,895,748 A 7/1975 Klingenberg
3,954,352 A 5/1976 Sakai
4,023,592 A 5/1977 Patzke et al.
4,093,403 A 6/1978 Schrimpf
4,452,265 A 6/1984 Lonnebring
4,483,665 A 11/1984 Hauser
4,541,455 A 9/1985 Hauser
4,597,719 A 7/1986 Tano et al.
4,597,721 A 7/1986 Santefort
4,601,409 A 7/1986 DiRegolo
4,614,438 A 9/1986 Kobayashi
4,671,545 A 6/1987 Miyazaki
4,690,621 A 9/1987 Swain
4,705,461 A 11/1987 Clements
4,797,834 A * 1/1989 Honganen et al. ..... 700/285
4,808,077 A * 2/1989 Kan et al. ..... 417/2
4,821,997 A 4/1989 Zdeblick
4,824,073 A 4/1989 Zdeblick
4,865,525 A 9/1989 Kern
4,915,126 A 4/1990 Gyllinder
4,943,032 A 7/1990 Zdeblick
4,950,134 A 8/1990 Bailey et al.
4,952,386 A 8/1990 Davison
4,966,646 A 10/1990 Zdeblick
5,061,156 A 10/1991 Kuehne et al.
5,061,574 A 10/1991 Henager, Jr. et al.
5,062,770 A 11/1991 Story
5,134,962 A 8/1992 Hiroshi et al.
5,135,031 A 8/1992 Burgess
5,167,837 A 12/1992 Snodgrass et al.
5,192,198 A 3/1993 Gebauer et al.
5,230,445 A 7/1993 Rusnak
5,261,442 A 11/1993 Kingsford et al.
5,262,068 A 11/1993 Bowers et al.
5,316,181 A 5/1994 Burch
5,318,413 A 6/1994 Bertoncini
5,344,195 A 9/1994 Parimore, Jr. et al.
5,350,200 A 9/1994 Peterson et al.
5,380,019 A 1/1995 Hillery et al.
5,434,774 A 7/1995 Seberger
5,476,004 A 12/1995 Kingsford
5,490,765 A 2/1996 Bailey et al.
5,511,797 A 4/1996 Nikirk et al.
5,516,429 A 5/1996 Snodgrass et al.
5,527,161 A 6/1996 Bailey et al.
5,546,009 A 8/1996 Raphael
5,575,311 A 11/1996 Kingsford
5,580,103 A 12/1996 Hall
5,599,100 A 2/1997 Jackson et al.
5,599,394 A 2/1997 Yabe et al.
5,645,301 A 7/1997 Kingsford et al.
5,652,391 A 7/1997 Kingsford et al.
5,653,251 A 8/1997 Handler
5,743,293 A 4/1998 Kelly
5,762,795 A 6/1998 Bailey
5,772,899 A 6/1998 Snodgrass et al.
5,785,508 A 7/1998 Bolt
5,793,754 A 8/1998 Houldsworth et al.
5,839,828 A 11/1998 Glanville
5,848,605 A 12/1998 Bailey et al.
5,947,702 A 9/1999 Biederstadt
5,971,723 A 10/1999 Bolt et al.
5,991,279 A 11/1999 Haugli et al.
6,033,302 A 3/2000 Ahmed et al.
6,105,829 A 8/2000 Snodgrass et al.
6,190,565 B1 2/2001 Bailey et al.
6,238,576 B1 5/2001 Yajima
6,250,502 B1 6/2001 Cote et al.
6,251,293 B1 6/2001 Snodgrass et al.
6,298,941 B1 10/2001 Spadafora
6,302,660 B1 10/2001 Kurita et al.
6,318,971 B1 11/2001 Ota
6,325,032 B1 12/2001 Sekiya et al.
6,325,932 B1 12/2001 Gibson
6,330,517 B1 12/2001 Dobrowski
6,348,124 B1 2/2002 Garbett
6,474,950 B1 11/2002 Waldo
6,478,547 B1 11/2002 Savard et al.
6,506,030 B1 1/2003 Kottke
6,520,519 B2 2/2003 Howard
6,540,265 B2 4/2003 Turk
6,554,579 B2 4/2003 Martin et al.
6,575,264 B2 6/2003 Spadafora
6,592,825 B2 7/2003 Pelc et al.
6,635,183 B2 10/2003 Gibson
6,742,992 B2 6/2004 Davis
6,742,993 B2 6/2004 Savard et al.
6,767,877 B2 7/2004 Kuo et al.
6,837,484 B2 1/2005 Kingsford et al.
6,901,791 B1 6/2005 Frenz et al.
6,925,072 B1 8/2005 Grohn
6,952,618 B2 10/2005 Davlin et al.
7,013,223 B1 3/2006 Zhang et al.
7,029,238 B1 4/2006 Zagars et al.
7,083,202 B2 8/2006 Eberle et al.
7,247,245 B1 7/2007 Proulx et al.
7,272,452 B2 9/2007 Coogan et al.
7,383,967 B2 6/2008 Gibson
7,454,317 B2 * 11/2008 Karasawa ..... 702/188
7,684,446 B2 3/2010 McLoughlin
7,850,431 B2 12/2010 Gonnella et al.
2002/0044536 A1 4/2002 Izumi et al.
2002/0095240 A1 7/2002 Sickinger
2003/0148759 A1 8/2003 Leliveld
2003/0222798 A1 12/2003 Floros
2004/0050771 A1 3/2004 Gibson
2004/0072450 A1 4/2004 Collins
2004/0133728 A1 7/2004 Ellerbrock et al.
2005/0061722 A1 * 3/2005 Takao et al. ..... 210/137
2005/0126985 A1 6/2005 Campbell
2005/0173463 A1 8/2005 Wesner
2005/0184087 A1 * 8/2005 Zagars et al. ..... 222/63
2005/0232296 A1 10/2005 Schultze et al.
2005/0238497 A1 10/2005 Holst
2006/0015294 A1 * 1/2006 Yetter et al. ..... 702/183
2006/0070960 A1 4/2006 Gibson
2006/0083259 A1 4/2006 Metcalf et al.
2008/0089361 A1 4/2008 Metcalf et al.

FOREIGN PATENT DOCUMENTS

CA 1271140 7/1990
CN 1590761 A 3/2005
DE 299 09 100 U1 8/1999
EP 0 249 655 A 12/1987
EP 0 410 394 A 1/1991
EP 0261972 B1 12/1992
EP 0892204 A2 1/1998
EP 0863538 A 9/1998
EP 0867649 A3 9/1998
EP 1133639 B1 6/2004
GB 661 522 A 11/1951
JP 11 026430 A 1/1999
WO WO 99/35876 A 11/1996
WO WO 00/31416 A1 6/2000
WO WO 01/40646 A3 6/2001
WO WO 02/090771 A2 11/2002

WO WO 2006/057957 A2 6/2006

OTHER PUBLICATIONS

Chinese Patent Office Official Action, Chinese Patent Application No. 2005101088364 dated May 23, 2008.
International Search Report and Written Opinion issued in PCT/US06/44985, 7 pages.
International Search Report and Written Opinion issued in PCT/US07/17017, Jul. 3, 2008, 9 pages.
European Patent Office Official Action, European Patent Application No. 00982386.5, Sep. 4, 2007.
International Search Report and Written Opinion, PCT/US2006/044906, Sep. 5, 2007.
International Search Report and Written Opinion, PCT/US2005/042127, Sep. 26, 2007.
International Search Report and Written Opinion, PCT/US2006/044980, Oct. 4, 2007.
Office Action issued in U.S. Appl. No. 11/602,513, dated May 22, 2008.
International Search Report and Written Opinion, PCT/US2006/045176, Apr. 21, 2008.
United States Patent Office Official Action issued in U.S. Appl. No. 11/051,576, Dec. 12, 2007.
International Search Report and Written Opinion issued in PCT/US06/44981, dated Aug. 8, 2008, 10 pages.
Chinese Patent Office Official Action, Chinese Patent Application No. 200410079193.0, Mar. 23, 2007.
International Search Report and Written Opinion, PCT/US2006/045127, May 23, 2007.
International Search Report and Written Opinion, PCT/US2006/044908, Jul. 16, 2007.
International Search Report and Written Opinion, PCT/US2006/045175, Jul. 25, 2007.
International Search Report and Written Opinion, PCT/US2006/044907, Aug. 8, 2007.
International Search Report and Written Opinion, PCT/US2006/045177, Aug. 9, 2007.
Office Action issued in U.S. Appl. No. 11/365,395, dated Aug. 19, 2008, McLoughlin, 19 pages.
Two-page brochure describing a Chempure Pump—a Furon Product.
Fifteen-page publication regarding—"Characterization of Low Viscosity Photoresist Coating," Murthy S. Krishna, John W. Llewellen, Gary E. Flores. Advances in Resist Technology and Processing XV (Proceedings of SPIE (The International Society for Optical Engineering), Santa Clara, California. vol. 3333 (Part Two of Two Parts), Feb. 23-25, 1998.
Office Action issued in U.S. Appl. No. 11/602,513, dated Nov. 14, 2008, Gashgaee, 7 pages.
Notification of Transmittal of International Preliminary Report on Patentability for PCT/US07/17017. Eight pages, Jan. 13, 2009.
International Preliminary Report on Patentability, Chap. I, issued in PCT/US2006/044981, 7 pgs., Nov. 6, 2008.
International Preliminary Report on Patentability, Chap. II, issued in PCT/US2006/044981, 9 pgs., Feb. 2, 2009.
Office Action issued in U.S. Appl. No. 11/365,395, McLoughlin, 18 pgs, Feb. 2, 2009.
Office Action issued in U.S. Appl. No. 11/292,559, mailed Dec. 24, 2008, Gonnella, 18 pgs.
Intellectual Property Office of Singapore, Written Opinion issued in Patent Application No. 200806425-5 dated Oct. 14, 2009, 8 pgs.
Office Action issued in U.S. Appl. No. 11/602,507 mailed Oct. 28, 2009, 12 pgs.
Office Action issued in U.S. Appl. No. 11/292,559 mailed Nov. 3, 2009, 17 pgs.
Office Action issued in Chinese Patent Application No. CN 200680045074.0, mailed Jun. 7, 2010, 8 pgs. (with English translation).
Office Action issued in Chinese Patent Application No. CN 200680050814.X (with English translation), mailed Aug. 6, 2010, 10 pgs.
Office Action issued Chinese Patent Appl. No. 200680050665.7, dated Mar. 11, 2010 (with English translation) 6 pgs.
Office Action issued in U.S. Appl. No. 11/292,559 mailed Apr. 14, 2010, 20 pgs.
Office Action issued in U.S. Appl. No. 11/602,508 mailed Apr. 15, 2010, 20 pgs.
Office Action issued in Chinese Patent Application No. CN 200680050801.2, mailed Mar. 26, 2010, 13 pgs. (with English translation).
Supplementary European Search Report and European Written Opinion in Application No. EP06838071.6, dated Apr. 28, 2010, 5 pgs.
Office Action issued in U.S. Appl. No. 11/602,485 mailed Jun. 9, 2010, 9 pgs.
Office Action issued in U.S. Appl. No. 11/602,507 mailed Jun. 14, 2010, 13 pgs.
Office Action issued in U.S. Appl. No. 11/602,472 mailed Jun. 18, 2010, 13 pgs.
Office Action issued in U.S. Appl. No. 11/602,465 mailed Jun. 18, 2010, 14 pgs.
Office Action issued in U.S. Appl. No. 11/602,464 mailed Jun. 21, 2010, 19 pgs.
Notice of Allowance issued in U.S. Appl. No. 11/602,507 mailed Oct. 14, 2010, 8 pgs.
Office Action issued in Chinese Patent Application No. CN 200780046952.5, mailed Sep. 27, 2010, 8 pgs. (English Translation).
Office Action issued in U.S. Appl. No. 11/602,485 mailed Nov. 19, 2010, 9 pgs.
Notice of Allowance for U.S. Appl. No. 11/602,508, mailed Dec. 14, 2010, 10 pgs.

* cited by examiner

SYSTEM AND METHOD FOR MONITORING OPERATION OF A PUMP

RELATED APPLICATIONS

This application is a continuation-in-part of, and claims a benefit of priority under 35 U.S.C. 120 to, the filing date of U.S. patent application Ser. No. 11/292,559 filed Dec. 2, 2005, entitled "System and Method for Control of Fluid Pressure" which is hereby incorporated into this application by reference in its entirety as if it had been fully set forth herein.

TECHNICAL FIELD OF THE INVENTION

This invention relates generally fluid pumps. More particularly, embodiments of the present invention relate to multi-stage pumps. Even more particularly, embodiments of the present invention relate to monitoring operation of a pump, including confirming various operations, or actions, of a multi-stage pump used in semiconductor manufacturing.

BACKGROUND OF THE INVENTION

There are many applications for which precise control over the amount and/or rate at which a fluid is dispensed by a pumping apparatus is necessary. In semiconductor processing, for example, it is important to control the amount and rate at which photochemicals, such as photoresist chemicals, are applied to a semiconductor wafer. The coatings applied to semiconductor wafers during processing typically require a flatness across the surface of the wafer that is measured in angstroms. The rates at which processing chemicals, such as photoresists chemicals, are applied to the wafer have to be controlled in order to ensure that the processing liquid is applied uniformly.

Many photochemicals used in the semiconductor industry today are very expensive, frequently costing as much as $1000 a liter. Therefore, it is preferable to ensure that a minimum but adequate amount of chemical is used and that the chemical is not damaged by the pumping apparatus. Current multiple stage pumps can cause sharp pressure spikes in the liquid. Such pressure spikes and subsequent drops in pressure may be damaging to the fluid (i.e., may change the physical characteristics of the fluid unfavorably). Additionally, pressure spikes can lead to built up fluid pressure that may cause a dispense pump to dispense more fluid than intended, or to introduce unfavorable dynamics into the dispense of the fluid.

Other conditions occurring within a multiple stage pump may also prevent proper dispense of chemical. These conditions, in the main, result from timing changes in the process. These timing changes may be intentional (e.g. recipe changes) or unintentional, for example signal lag etc.

When these conditions occur, the result can be an improper dispense of chemical. In some cases no chemical may be dispensed onto a wafer, while in other cases chemical may be non-uniformly distributed across the surface of the wafer. The wafer may then undergo one or more remaining steps of a manufacturing process, rendering the wafer unsuitable for use and resulting, eventually, in the wafer being discarded as scrap.

Exacerbating this problem is the fact that, in many cases, the scrap wafer may only be detected using some form of quality control procedure. Meanwhile, however, the condition that resulted in the improper dispense, and hence the scrap wafer, has persisted. Consequently, in the interim between when the first improper dispense, and the detection of the scrap wafer created by this improper dispense, many additional improper deposits have occurred on other wafers. These wafers must, in turn, also be discarded as scrap.

As can be seen, then, it is desirable to detect or confirm that a proper dispense has occurred. This confirmation has, in the past, been accomplished using a variety of techniques. The first of these involves utilizing a camera system at the dispense nozzle of a pump to confirm that a dispense has taken place. This solution is non-optimal however, as these camera systems are usually independent of the pump and thus must be separately installed and calibrated. Furthermore, in the vast majority of cases, these camera systems tend to be prohibitively expensive.

Another method involves the use of a flow meter in the fluid path of the pump to confirm a dispense. This method is also problematic. An additional component inserted into the flow path of the pump not only raises the cost of the pump itself but also increase the risk of contamination of the chemical as it flows through the pump.

Thus, as can be seen, what is needed are methods and systems for confirming operations and actions of a pump which may quickly and accurately detect the proper completion of these operations and actions.

SUMMARY OF THE INVENTION

Systems and methods for monitoring operation of a pump, including verifying operation or actions of a pump, are disclosed. A baseline profile for one or more parameters of a pump may be established. An operating profile may then be created by recording one or more values for the same set of parameters during subsequent operation of the pump. The values of the baseline profile and the operating profile may then be compared at one or more points or sets of points. If the operating profile differs from the baseline profile by more than a certain tolerance an alarm may be sent or another action taken, for example the pumping system may shut down, etc.

In one embodiment, a multiple stage pump that has a first stage pump (e.g., a feed pump) and a second stage pump (e.g., a dispense pump) with a pressure sensor to determine the pressure of a fluid at the second stage pump. A pump controller can monitor the operation of the pump. The pump controller is coupled to the first stage pump, second stage pump and pressure sensor (i.e., is operable to communicate with the first stage pump, second stage pump and pressure sensor) and is operable create a first operating profile corresponding to a parameter and compare each of one or more values associated with the first operating profile with a corresponding value associated with a baseline profile to determine if each of the one or more values is within a tolerance of the corresponding value.

Yet another embodiment of the present invention comprises a computer program product for controlling a pump. The computer program product can comprise a set of computer instructions stored on one or more computer readable media that include instructions executable by one or more processors to create a first operating profile corresponding to a parameter and compare each of one or more values associated with the first operating profile with a corresponding value associated with a baseline profile to determine if each of the one or more values is within a tolerance of the corresponding value.

In another embodiment, an operating profile is created by recording a value for a parameter at points during the operation of the pump.

In one particular embodiment, these points are between 1 millisecond and 10 milliseconds apart.

In other embodiments, the parameter is a pressure of a fluid.

Embodiments of the present invention provide an advantage by detecting a variety of problems relating to the operations and actions of a pumping system. For example, by comparing a baseline pressure at one or more points to one or more points of a pressure profile measured during operation of a pump an improper dispense may be detected. Similarly, by comparing the rate of operation of a motor during one or more stages of operation of the pump to a baseline rate of operation for this motor clogging of a filter in the pumping system may be detected.

Another advantage provided by embodiments of the present invention is that malfunctions or impending failure of components of the pump may be detected.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore nonlimiting, embodiments illustrated in the drawings, wherein identical reference numerals designate the same components. Note that the features illustrated in the drawings are not necessarily drawn to scale.

DETAILED DESCRIPTION

Preferred embodiments of the present invention are illustrated in the FIGUREs, like numerals being used to refer to like and corresponding parts of the various drawings.

Embodiments of the present invention are related to a pumping system that accurately dispenses fluid using a pump. More particularly, embodiments of the present invention are related to systems and methods for monitoring operation of a pump, including confirming or verifying operation or actions of a pump. According to one embodiment, the present invention provide a method for verifying an accurate dispense of fluid from the pump, the proper operation of a filter within the pump, etc. A baseline profile for one or more parameters of a pump may be established. An operating profile may then be created by recording one or more values for the same set of parameters during subsequent operation of the pump. The values of the baseline profile and the operating profile may then be compared at one or more points or sets of points. If the operating profile differs from the baseline profile by more than a certain tolerance an alarm may be sent or another action taken, for example the pumping system may shut down, etc.

These systems and methods may be used to detect a variety of problems relating to the operations and actions of a pump. For example, by comparing a baseline pressure at one or more points to one or more points of a pressure profile measured during operation of a pump an improper dispense may be detected. Similarly, by comparing the rate of operation of a motor during one or more stages of operation of the pump to a baseline rate of operation for this motor, clogging of a filter in the pump may be detected. These, and other uses for the systems and methods of the present invention will become manifest after review of the following disclosure.

Figure 1:
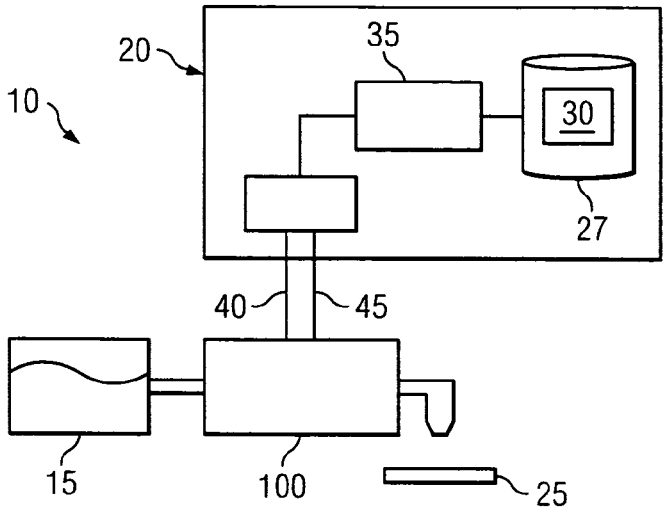
FIG. 1 is a diagrammatic representation of one embodiment of a pumping system.

Before describing embodiments of the present invention it may be useful to describe exemplary embodiments of a pump or pumping system which may be utilized with various embodiments of the present invention. FIG. 1 is a diagrammatic representation, of a pumping system 10. The pumping system 10 can include a fluid source 15, a pump controller 20 and a multi-stage pump 100, which work together to dispense fluid onto a wafer 25. The operation of multi-stage pump 100 can be controlled by pump controller 20, which can be onboard multi-stage pump 100 or connected to multi-stage pump 100 via a one or more communications links for communicating control signals, data or other information. Pump controller 20 can include a computer readable medium 27 (e.g., RAM, ROM, Flash memory, optical disk, magnetic drive or other computer readable medium) containing a set of control instructions 30 for controlling the operation of multi-stage pump 100. A processor 35 (e.g., CPU, ASIC, RISC or other processor) can execute the instructions. One example of a processor is the Texas Instruments TMS320F2812PGFA 16-bit DSP (Texas Instruments is Dallas, Tex. based company). In the embodiment of FIG. 1, controller 20 communicates with multi-stage pump 100 via communications links 40 and 45. Communications links 40 and 45 can be networks (e.g., Ethernet, wireless network, global area network, DeviceNet network or other network known or developed in the art), a bus (e.g., SCSI bus) or other communications link. Controller 20 can be implemented as an onboard PCB board, remote controller or in other suitable manner. Pump controller 20 can include appropriate interfaces (e.g., network interfaces, I/O interfaces, analog to digital converters and other components) to allow pump controller 20 to communicate with multi-stage pump 100. Pump controller 20 can include a variety of computer components known in the art including processors, memories, interfaces, display devices, peripherals or other computer components. Pump controller 20 can control various valves and motors in multi-stage pump to cause multi-stage pump to accurately dispense fluids, including low viscosity fluids (i.e., less than 5 centipoise) or other fluids. Pump controller 20 may also execute instruction operable to implement embodiments of the systems and methods described herein.

Figure 2:
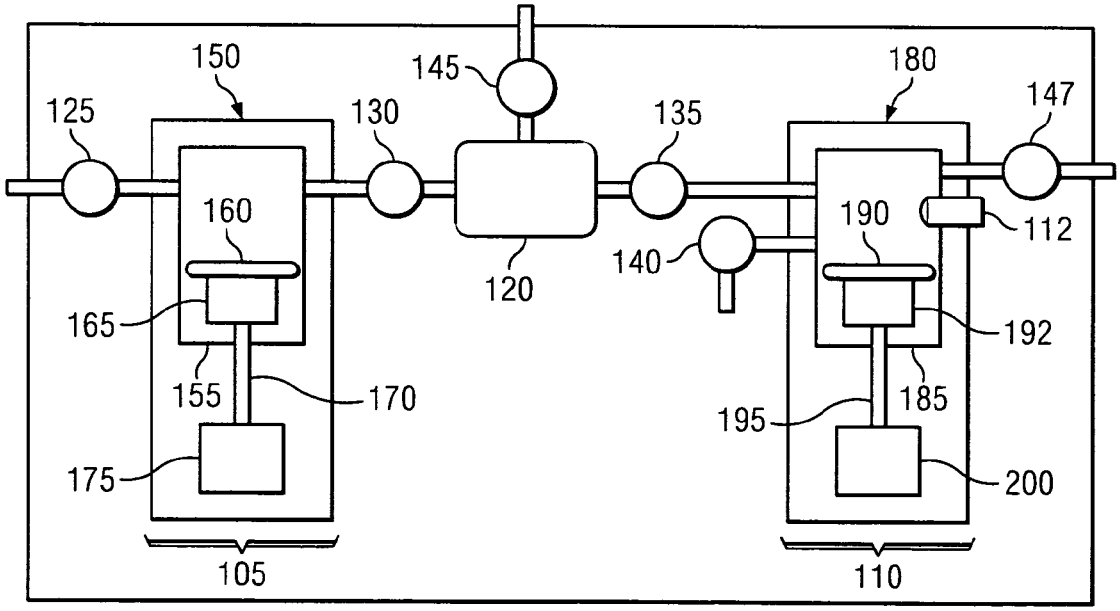
FIG. 2 is a diagrammatic representation of a multiple stage pump ("multi-stage pump") according to one embodiment of the present invention.

FIG. 2 is a diagrammatic representation of a multi-stage pump 100. Multi-stage pump 100 includes a feed stage portion 105 and a separate dispense stage portion 110. Located between feed stage portion 105 and dispense stage portion 110, from a fluid flow perspective, is filter 120 to filter impurities from the process fluid. A number of valves can control fluid flow through multi-stage pump 100 including, for example, inlet valve 125, isolation valve 130, barrier valve 135, purge valve 140, vent valve 145 and outlet valve 147. Dispense stage portion 110 can further include a pressure sensor 112 that determines the pressure of fluid at dispense stage 110. The pressure determined by pressure sensor 112 can be used to control the speed of the various pumps as described below. Example pressure sensors include ceramic and polymer pesioresistive and capacitive pressure sensors, including those manufactured by Metallux AG, of Korb, Germany.

Feed stage 105 and dispense stage 110 can include rolling diaphragm pumps to pump fluid in multi-stage pump 100. Feed-stage pump 150 ("feed pump 150"), for example, includes a feed chamber 155 to collect fluid, a feed stage diaphragm 160 to move within feed chamber 155 and displace fluid, a piston 165 to move feed stage diaphragm 160, a lead screw 170 and a stepper motor 175. Lead screw 170 couples to stepper motor 175 through a nut, gear or other mechanism for imparting energy from the motor to lead screw 170. According to one embodiment, feed motor 170 rotates a nut that, in turn, rotates lead screw 170, causing piston 165 to actuate. Dispense-stage pump 180 ("dispense pump 180") can similarly include a dispense chamber 185, a dispense stage diaphragm 190, a piston 192, a lead screw 195, and a dispense motor 200. According to other embodiments, feed stage 105 and dispense stage 110 can each be include a variety of other pumps including pneumatically actuated pumps, hydraulic pumps or other pumps. One example of a multi-stage pump using a pneumatically actuated pump for the feed stage and a stepper motor driven hydraulic pump is described in U.S. patent application Ser. No. 11/051,576, which is hereby fully incorporated by reference herein.

Feed motor 175 and dispense motor 200 can be any suitable motor. According to one embodiment, dispense motor 200 is a Permanent-Magnet Synchronous Motor ("PMSM"). The PMSM can be controlled by a digital signal processor ("DSP") utilizing Field-Oriented Control ("FOC") at motor 200, a controller onboard multi-stage pump 100 or a separate pump controller (e.g. as shown in FIG. 1). PMSM 200 can further include an encoder (e.g., a fine line rotary position encoder) for real time feedback of dispense motor 200's position. The use of a position sensor gives accurate and repeatable control of the position of piston 192, which leads to accurate and repeatable control over fluid movements in dispense chamber 185. For, example, using a 2000 line encoder, it is possible to accurately measure to and control at 0.045 degrees of rotation. In addition, a PMSM can run at low velocities with little or no vibration. Feed motor 175 can also be a PMSM or a stepper motor. According to one embodiment of the present invention, feed stage motor 175 can be a stepper motor part number L1LAB-005 and dispense stage motor 200 can be a brushless DC motor part number DA23DBBL-13E17A, both from EAD motors of Dover, N.H. USA.

The valves of multi-stage pump 100 are opened or closed to allow or restrict fluid flow to various portions of multi-stage pump 100. According to one embodiment, these valves can be pneumatically actuated (i.e., gas driven) diaphragm valves that open or close depending on whether pressure or a vacuum is asserted. However, in other embodiments of the present invention, any suitable valve can be used.

In operation, multi-stage pump 100 can include a ready segment, dispense segment, fill segment, pre-filtration segment, filtration segment, vent segment, purge segment and static purge segment. During the feed segment, inlet valve 125 is opened and feed stage pump 150 moves (e.g., pulls) feed stage diaphragm 160 to draw fluid into feed chamber 155. Once a sufficient amount of fluid has filled feed chamber 155, inlet valve 125 is closed. During the filtration segment, feed-stage pump 150 moves feed stage diaphragm 160 to displace fluid from feed chamber 155. Isolation valve 130 and barrier valve 135 are opened to allow fluid to flow through filter 120 to dispense chamber 185. Isolation valve 130, according to one embodiment, can be opened first (e.g., in the "pre-filtration segment") to allow pressure to build in filter 120 and then barrier valve 135 opened to allow fluid flow into dispense chamber 185. During the filtration segment, dispense pump 180 can be brought to its home position. As described in U.S. Provisional Patent Application No. 60/630,384, entitled "System and Method for a Variable Home Position Dispense System" by Laverdiere, et al. filed Nov. 23, 2004 and PCT Application No. PCT/US2005/042127, entitled "System and Method for Variable Home Position Dispense System", by Laverdiere et al., filed Nov. 21 2005, each of which is fully incorporated by reference herein, the home position of the dispense pump can be a position that gives the greatest available volume at the dispense pump for the dispense cycle, but is less than the maximum available volume that the dispense pump could provide. The home position is selected based on various parameters for the dispense cycle to reduce unused hold up volume of multi-stage pump 100. Feed pump 150 can similarly be brought to a home position that provides a volume that is less than its maximum available volume.

As fluid flows into dispense chamber 185, the pressure of the fluid increases. According to one embodiment of the present invention, when the fluid pressure in dispense chamber 185 reaches a predefined pressure set point (e.g., as determined by pressure. sensor 112), dispense stage pump 180 begins to withdraw dispense stage diaphragm 190. In other words, dispense stage pump 180 increases the available volume of dispense chamber 185 to allow fluid to flow into dispense chamber 185. This can be done, for example, by reversing dispense motor 200 at a predefined rate, causing the pressure in dispense chamber 185 to decrease. If the pressure in dispense chamber 185 falls below the set point (within the tolerance of the system), the rate of feed motor 175 is increased to cause the pressure in dispense chamber 185 to reach the set point. If the pressure exceeds the set point (within the tolerance of the system) the rate of feed stepper motor 175 is decreased, leading to a lessening of pressure in downstream dispense chamber 185. The process of increasing and decreasing the speed of feed-stage motor 175 can be repeated until the dispense stage pump reaches a home position, at which point both motors can be stopped.

According to another embodiment, the speed of the first-stage motor during the filtration segment can be controlled using a "dead band" control scheme. When the pressure in dispense chamber 185 reaches an initial threshold, dispense stage pump can move dispense stage diaphragm 190 to allow fluid to more freely flow into dispense chamber 185, thereby causing the pressure in dispense chamber 185 to drop. If the pressure drops below a minimum pressure threshold, the speed of feed-stage motor 175 is increased, causing the pressure in dispense chamber 185 to increase. If the pressure in dispense chamber 185 increases beyond a maximum pressure threshold, the speed of feed-stage motor 175 is decreased. Again, the process of increasing and decreasing the speed of feed-stage motor 175 can be repeated until the dispense stage pump reaches a home position.

At the beginning of the vent segment, isolation valve 130 is opened, barrier valve 135 closed and vent valve 145 opened. In another embodiment, barrier valve 135 can remain open during the vent segment and close at the end of the vent segment. During this time, if barrier valve 135 is open, the pressure can be understood by the controller because the pressure in the dispense chamber, which can be measured by pressure sensor 112, will be affected by the pressure in filter 120. Feed-stage pump 150 applies pressure to the fluid to remove air bubbles from filter 120 through open vent valve 145. Feed-stage pump 150 can be controlled to cause venting to occur at a predefined rate, allowing for longer vent times and lower vent rates, thereby allowing for accurate control of the amount of vent waste. If feed pump is a pneumatic style pump, a fluid flow restriction can be placed in the vent fluid path, and the pneumatic pressure applied to feed pump can be increased or decreased in order to maintain a "venting" set point pressure, giving some control of an other wise uncontrolled method.

At the beginning of the purge segment, isolation valve 130 is closed, barrier valve 135, if it is open in the vent segment, is closed, vent valve 145 closed, and purge valve 140 opened and inlet valve 125 opened. Dispense pump 180 applies pressure to the fluid in dispense chamber 185 to vent air bubbles through purge valve 140. During the static purge segment, dispense pump 180 is stopped, but purge valve 140 remains open to continue to vent air. Any excess fluid removed during the purge or static purge segments can be routed out of multi-stage pump 100 (e.g., returned to the fluid source or discarded) or recycled to feed-stage pump 150. During the ready segment, isolation valve 130 and barrier valve 135 can be opened and purge valve 140 closed so that feed-stage pump 150 can reach ambient pressure of the source (e.g., the source bottle). According to other embodiments, all the valves can be closed at the ready segment.

During the dispense segment, outlet valve 147 opens and dispense pump 180 applies pressure to the fluid in dispense chamber 185. Because outlet valve 147 may react to controls more slowly than dispense pump 180, outlet valve 147 can be opened first and some predetermined period of time later dispense motor 200 started. This prevents dispense pump 180 from pushing fluid through a partially opened outlet valve 147. Moreover, this prevents fluid moving up the dispense nozzle caused by the valve opening, followed by forward fluid motion caused by motor action. In other embodiments, outlet valve 147 can be opened and dispense begun by dispense pump 180 simultaneously.

An additional suckback segment can be performed in which excess fluid in the dispense nozzle is removed. During the suckback segment, outlet valve 147 can close and a secondary motor or vacuum can be used to suck excess fluid out of the outlet nozzle. Alternatively, outlet valve 147 can remain open and dispense motor 200 can be reversed to such fluid back into the dispense chamber. The suckback segment helps prevent dripping of excess fluid onto the wafer.

Figure 3:
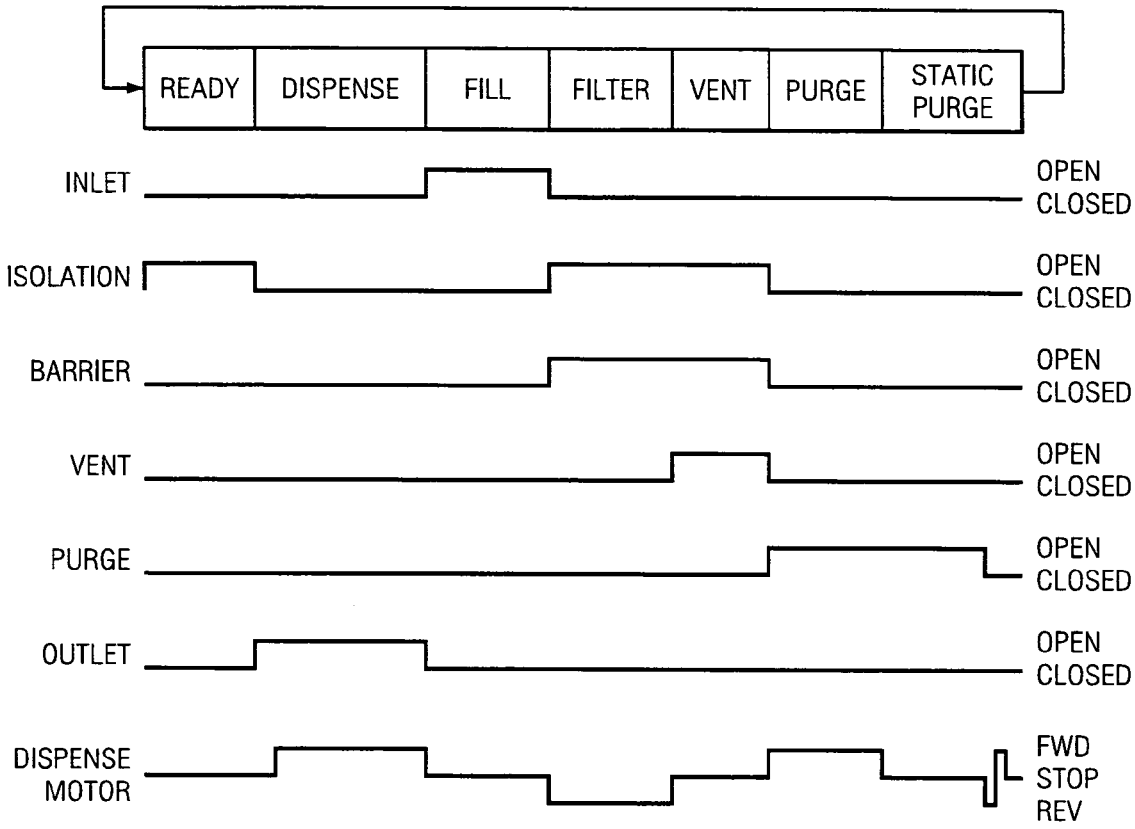
FIG. 3 is a diagrammatic representation of valve and motor timings for one embodiment of the present invention.

Referring briefly to FIG. 3, this figure provides a diagrammatic representation of valve and dispense motor timings for various segments of the operation of multi-stage pump 100 of FIG. 1. While several valves are shown as closing simultaneously during segment changes, the closing of valves can be timed slightly apart (e.g., 100 milliseconds) to reduce pressure spikes. For example, between the vent and purge segment, isolation valve 130 can be closed shortly before vent valve 145. It should be noted, however, other valve timings can be utilized in various embodiments of the present invention. Additionally, several of the segments can be performed together (e.g., the fill/dispense stages can be performed at the same time, in which case both the inlet and outlet valves can be open in the dispense/fill segment). It should be further noted that specific segments do not have to be repeated for each cycle. For example, the purge and static purge segments may not be performed every cycle. Similarly, the vent segment may not be performed every cycle.

The opening and closing of various valves can cause pressure spikes in the fluid. Closing of purge valve 140 at the end of the static purge segment, for example, can cause a pressure increase in dispense chamber 185. This can occur, because each valve may displace a small volume of fluid when it closes. Purge valve 140, for example, can displace a small volume of fluid into dispense chamber 185 as it closes. Because outlet valve 147 is closed when the pressure increases occur due to the closing of purge valve 140, "spitting" of fluid onto the wafer may occur during the subsequent dispense segment if the pressure is not reduced. To release this pressure during the static purge segment, or an additional segment, dispense motor 200 may be reversed to back out piston 192 a predetermined distance to compensate for any pressure increase caused by the closure of barrier valve 135 and/or purge valve 140.

Pressure spikes can be caused by closing (or opening) other valves, not just purge valve 140. It should be further noted that during the ready segment, the pressure in dispense chamber 185 can change based on the properties of the diaphragm, temperature or other factors. Dispense motor 200 can be controlled to compensate for this pressure drift.

Thus, embodiments of the present invention provide a multi-stage pump with gentle fluid handling characteristics. By controlling the operation of the feed pump, based on real-time teed back from a pressure sensor at the dispense pump, potentially damaging pressure spikes can be avoided. Embodiments of the present invention can also employ other pump control mechanisms and valve linings to help reduce deleterious effects of pressure on a process fluid.

Figure 4:
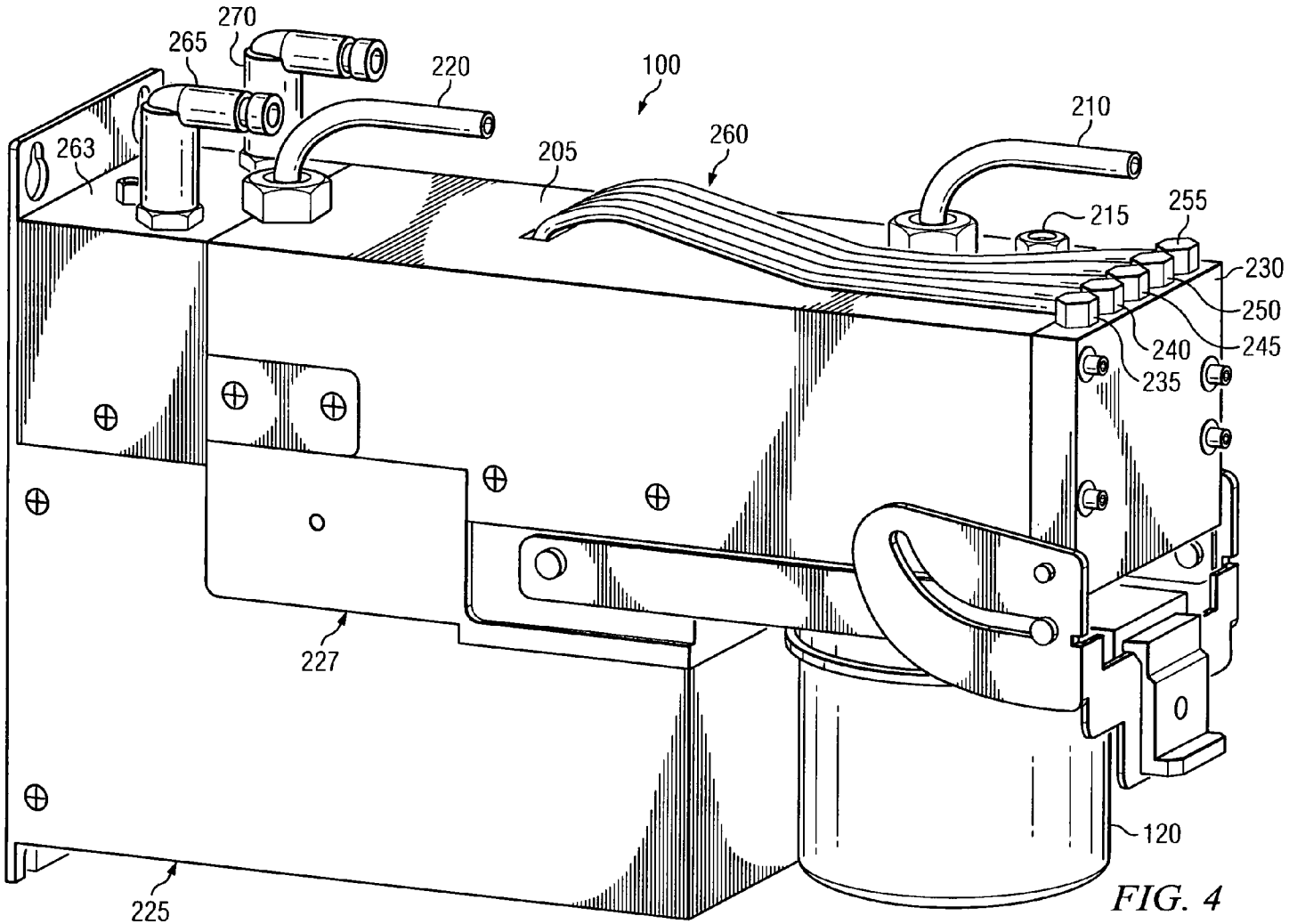
FIGS. 4 and 5A-5C are diagrammatic representations of one embodiment of a multi-stage pump.

FIG. 4 is a diagrammatic representation of one embodiment of a pump assembly for multi-stage pump 100. Multi-stage pump 100 can include a dispense block 205 that defines various fluid flow paths through multi-stage pump 100. Dispense pump block 205, according to one embodiment, can be a unitary block of Teflon. Because Teflon does not react with or is minimally reactive with many process fluids, the use of Teflon allows flow passages and pump chambers to be machined directly into dispense block 205 with a minimum of additional hardware. Dispense block 205 consequently reduces the need for piping by providing a fluid manifold.

Figure 5A:
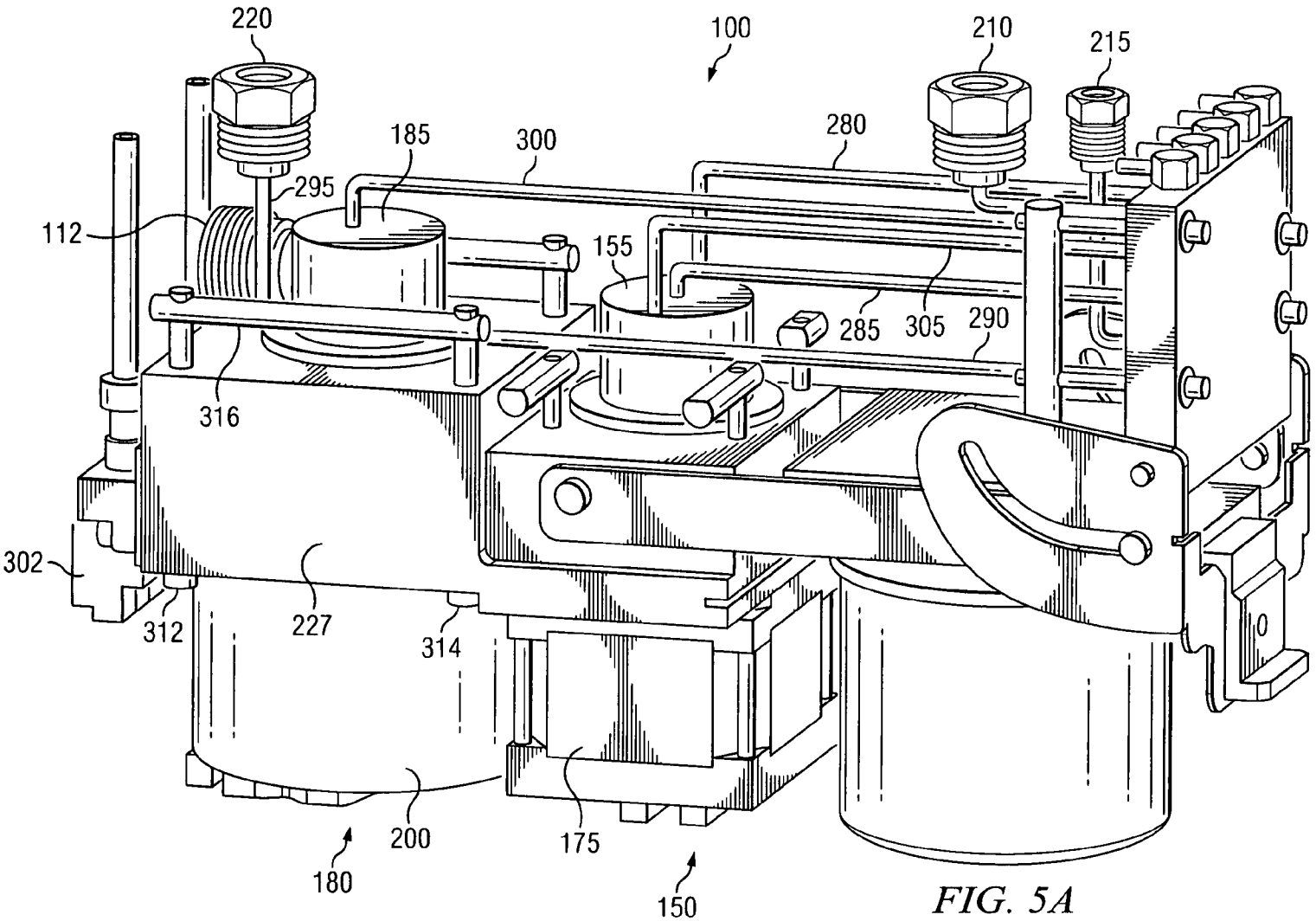
Figure 5B:
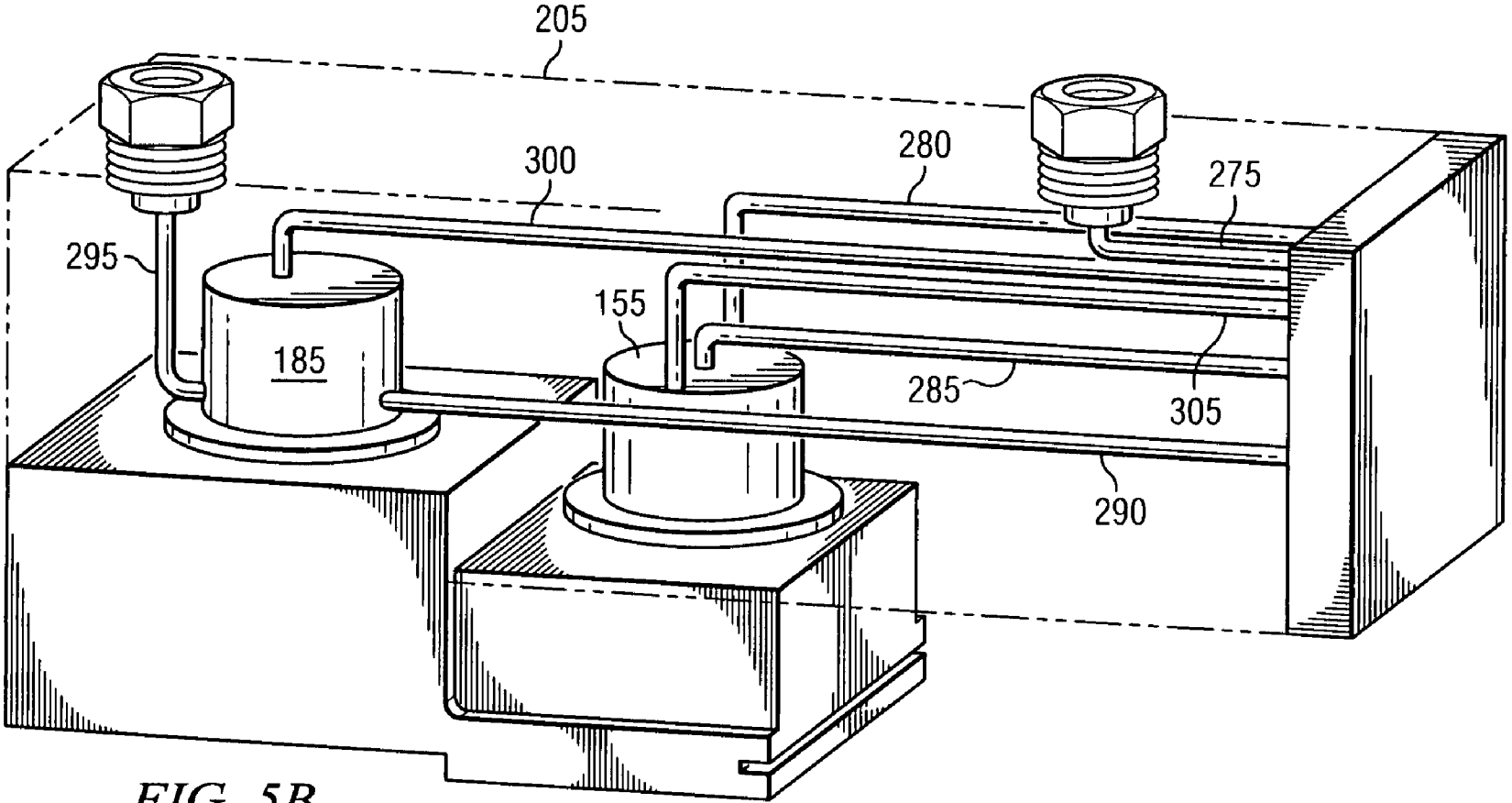

Dispense block 205 can include various external inlets and outlets including, for example, inlet 210 through which the fluid is received, vent outlet 215 for venting fluid during the vent segment, and dispense outlet 220 through which fluid is dispensed during the dispense segment. Dispense block 205, in the example of FIG. 4, does not include an external purge outlet as purged fluid is routed back to the feed chamber (as shown in FIG. 5A and FIG. 5B). In other embodiments of the present invention, however, fluid can be purged externally.

Dispense block 205 routes fluid to the feed pump, dispense pump and filter 120. A pump cover 225 can protect feed motor 175 and dispense motor 200 from damage, while piston housing 227 can provide protection for piston 165 and piston 192. Valve plate 230 provides a valve housing for a system of valves (e.g., inlet valve 125, isolation valve 130, barrier valve 135, purge valve 140, vent valve 145, and outlet valve 147 of FIG. 2) that can be configured to direct fluid flow to various components of multi-stage pump 100. According to one embodiment, each of inlet valve 125, isolation valve 130, barrier valve 135, purge valve 140, vent valve 145, and outlet valve 147 is integrated into valve plate 230 and is a diaphragm valve that is either opened or closed depending on whether pressure or vacuum is applied to the corresponding diaphragm. For each valve, a PTFE or modified PTFE diaphragm is sandwiched between valve plate 230 and dispense block 205. Valve plate 230 includes a valve control inlet for each valve to apply pressure or vacuum to the corresponding diaphragm. For example, inlet 235 corresponds to barrier valve 135, inlet 240 to purge valve 140, inlet 245 to isolation valve 130, inlet 250 to vent valve 145, and inlet 255 to inlet valve 125. By the selective application of pressure or vacuum to the inlets, the corresponding valves are opened and closed.

A valve control gas and vacuum are provided to valve plate 230 via valve control supply lines 260, which run from a valve control manifold (covered by manifold cover 263), through dispense block 205 to valve plate 230. Valve control gas supply inlet 265 provides a pressurized gas to the valve control manifold and vacuum inlet 270 provides vacuum (or low pressure) to the valve control manifold. The valve control manifold acts as a three way valve to route pressurized gas or vacuum to the appropriate inlets of valve plate 230 via supply lines 260 to actuate the corresponding valve(s).

FIG. 5A is a diagrammatic representation of one embodiment of multi-stage pump 100 with dispense block 205 made transparent to show the fluid flow passages defined there through. Dispense block 205 defines various chambers and fluid flow passages for multi-stage pump 100. According to one embodiment, feed chamber 155 and dispense chamber 185 can be machined directly into dispense block 205. Additionally, various flow passages can be machined into dispense block 205. Fluid flow passage 275 (shown in FIG. 5C) runs from inlet 210 to the inlet valve. Fluid flow passage 280 runs from the inlet valve to feed chamber 155, to complete the path from inlet 210 to feed pump 150. Inlet valve 125 in valve housing 230 regulates flow between inlet 210 and feed pump 150. Flow passage 285 routes fluid from feed pump 150 to isolation valve 130 in valve plate 230. The output of isolation valve 130 is routed to filter 120 by another flow passage (not shown). Fluid flows from filter 120 through flow passages that connect filter 120 to the vent valve 145 and barrier valve 135. The output of vent valve 145 is routed to vent outlet 215 while the output of barrier valve 135 is routed to dispense pump 180 via flow passage 290. Dispense pump, during the dispense segment, can output fluid to outlet 220 via flow passage 295 or, in the purge segment, to the purge valve through flow passage 300. During the purge segment, fluid can be returned to feed pump 150 through flow passage 305. Because the fluid flow passages can be formed directly in the Teflon (or other material) block, dispense block 205 can act as the piping for the process fluid between various components of multi-stage pump 100, obviating or reducing the need for additional tubing. In other cases, tubing can be inserted into dispense block 205 to define the fluid flow passages. FIG. 5B provides a diagrammatic representation of dispense block 205 made transparent to show several of the flow passages therein, according to one embodiment.

FIG. 5A also shows multi-stage pump 100 with pump cover 225 and manifold cover 263 removed to shown feed pump 150, including feed stage motor 190, dispense pump 180, including dispense motor 200, and valve control manifold 302. According to one embodiment of the present invention, portions of feed pump 150, dispense pump 180 and valve plate 230 can be coupled to dispense block 205 using bars (e.g., metal bars) inserted into corresponding cavities in dispense block 205. Each bar can include on or more threaded holes to receive a screw. As an example, dispense motor 200 and piston housing 227 can be mounted to dispense block 205 via one or more screws (e.g., screw 275 and screw 280) that run through screw holes in dispense block 205 to thread into corresponding holes in bar 285. It should be noted that this mechanism for coupling components to dispense block 205 is provided by way of example and any suitable attachment mechanism can be used.

Figure 5C:
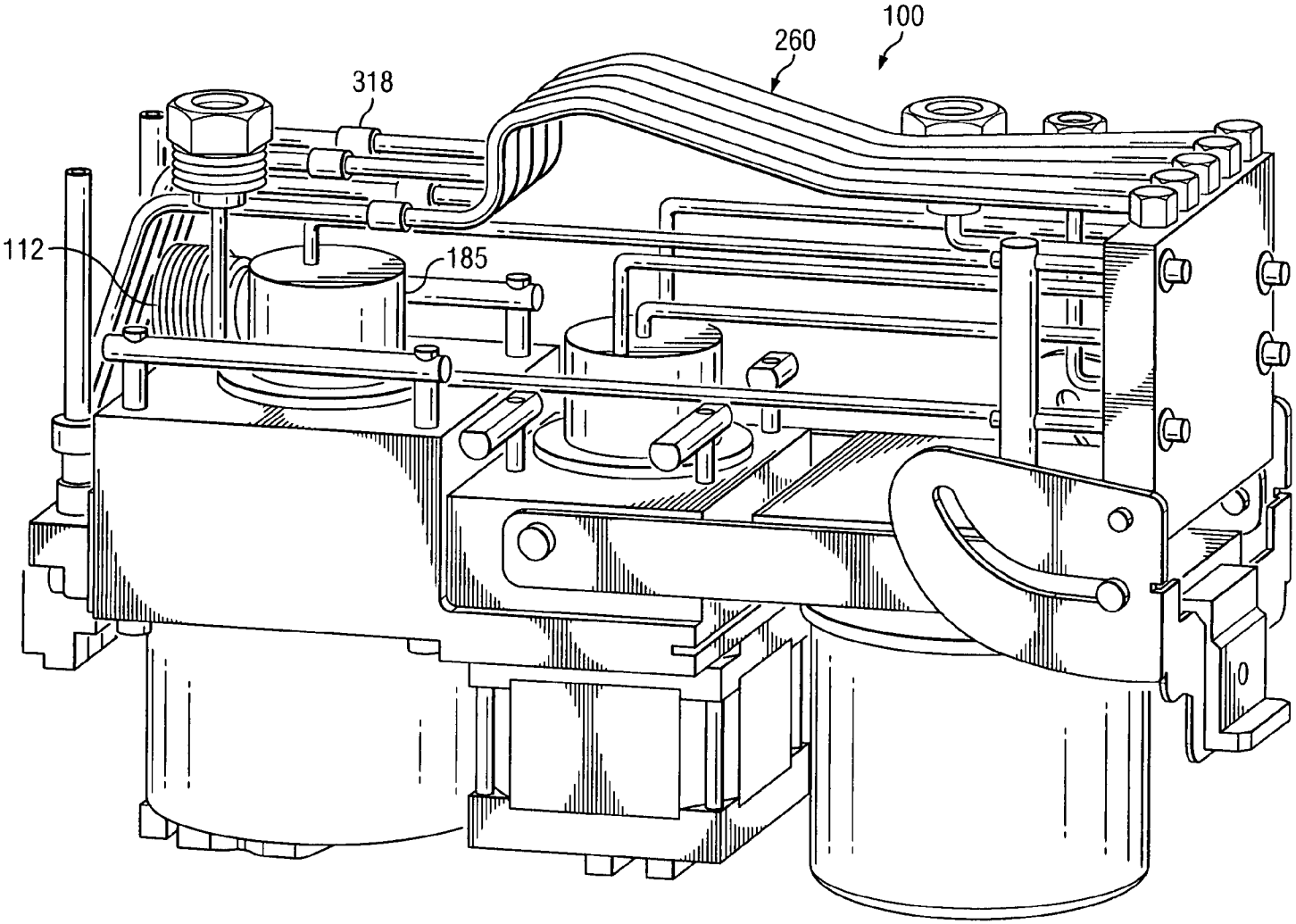

FIG. 5C is a diagrammatic representation of multi-stage pump 100 showing supply lines 260 for providing pressure or vacuum to valve plate 230. As discussed in conjunction with FIG. 4, the valves in valve plate 230 can be configured to allow fluid to flow to various components of multi-stage pump 100. Actuation of the valves is controlled by the valve control manifold 302 that directs either pressure or vacuum to each supply line 260. Each supply line 260 can include a fitting (an example fitting is indicated at 318) with a small orifice (i.e., a restriction). The orifice in each supply line helps mitigate the effects of sharp pressure differences between the application of pressure and vacuum to the supply line. This allows the valves to open and close more smoothly.

Figure 6:
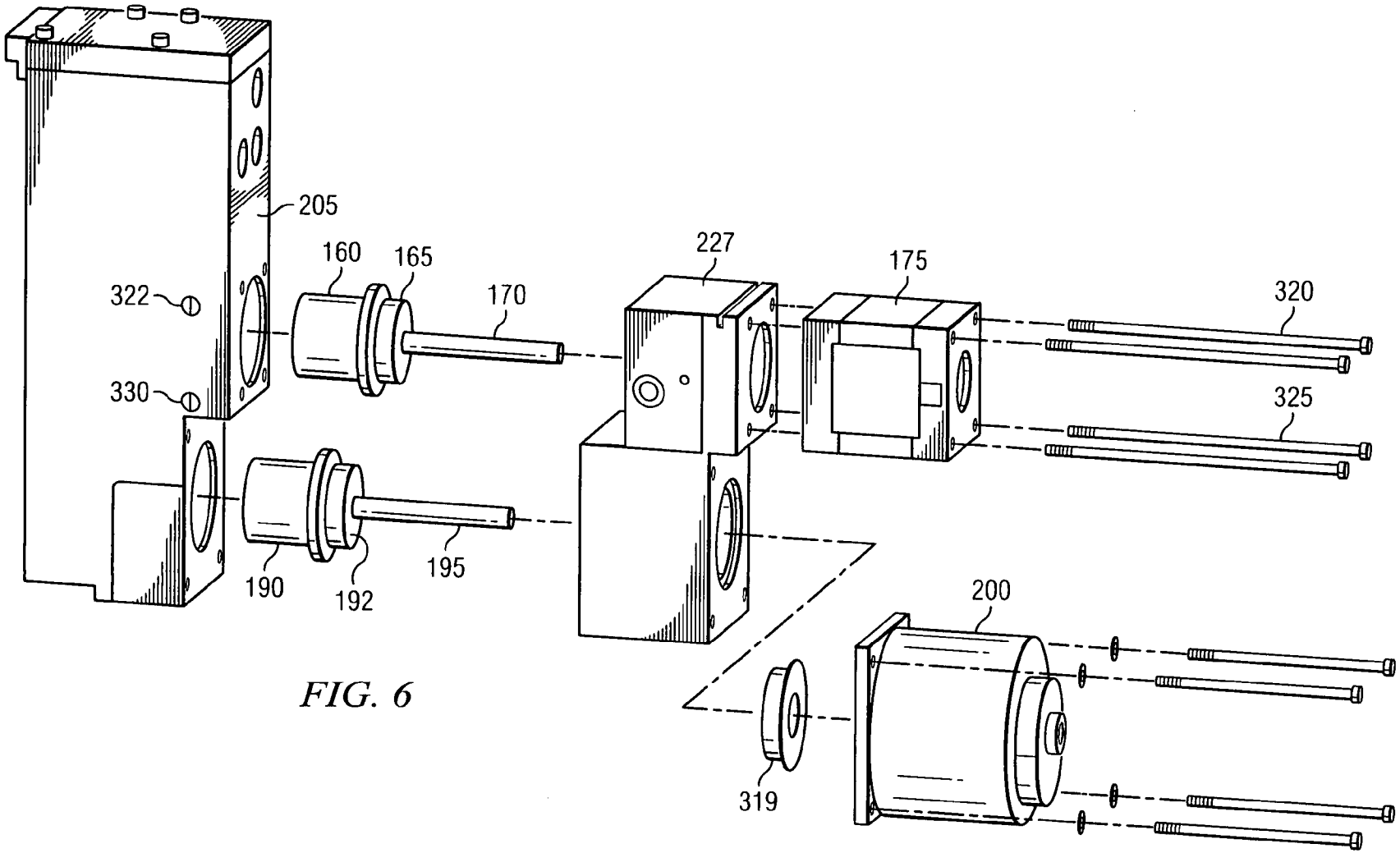
FIG. 6 is a diagrammatic representation of one embodiment of a partial assembly of a multi-stage pump.

FIG. 6 is a diagrammatic representation illustrating the partial assembly of one embodiment of multi-stage pump 100. In FIG. 6, valve plate 230 is already coupled to dispense block 205, as described above. For feed stage pump 150, diaphragm 160 with lead screw 170 can be inserted into the feed chamber 155, whereas for dispense pump 180, diaphragm 190 with lead screw 195 can be inserted into dispense chamber 185. Piston housing 227 is placed over the feed and dispense chambers with the lead screws running there through. Dispense motor 200 couples to lead screw 195 and can impart rotation to lead screw 195 through a rotating female-threaded nut. Similarly, feed motor 175 is coupled to lead screw 170 and can also impart rotation to lead screw 170 through a rotating female-threaded nut. A spacer 310 can be used to offset dispense motor 200 from piston housing 227. Screws in the embodiment shown, attach feed motor 175 and dispense motor 200 to multi-stage pump 100 using bars with threaded holes inserted into dispense block 205, as described in conjunction with FIG. 5. For example, screw 315 can be threaded into threaded holes in bar 320 and screw 325 can be threaded into threaded holes in bar 330 to attach feed motor 175.

Figure 7:
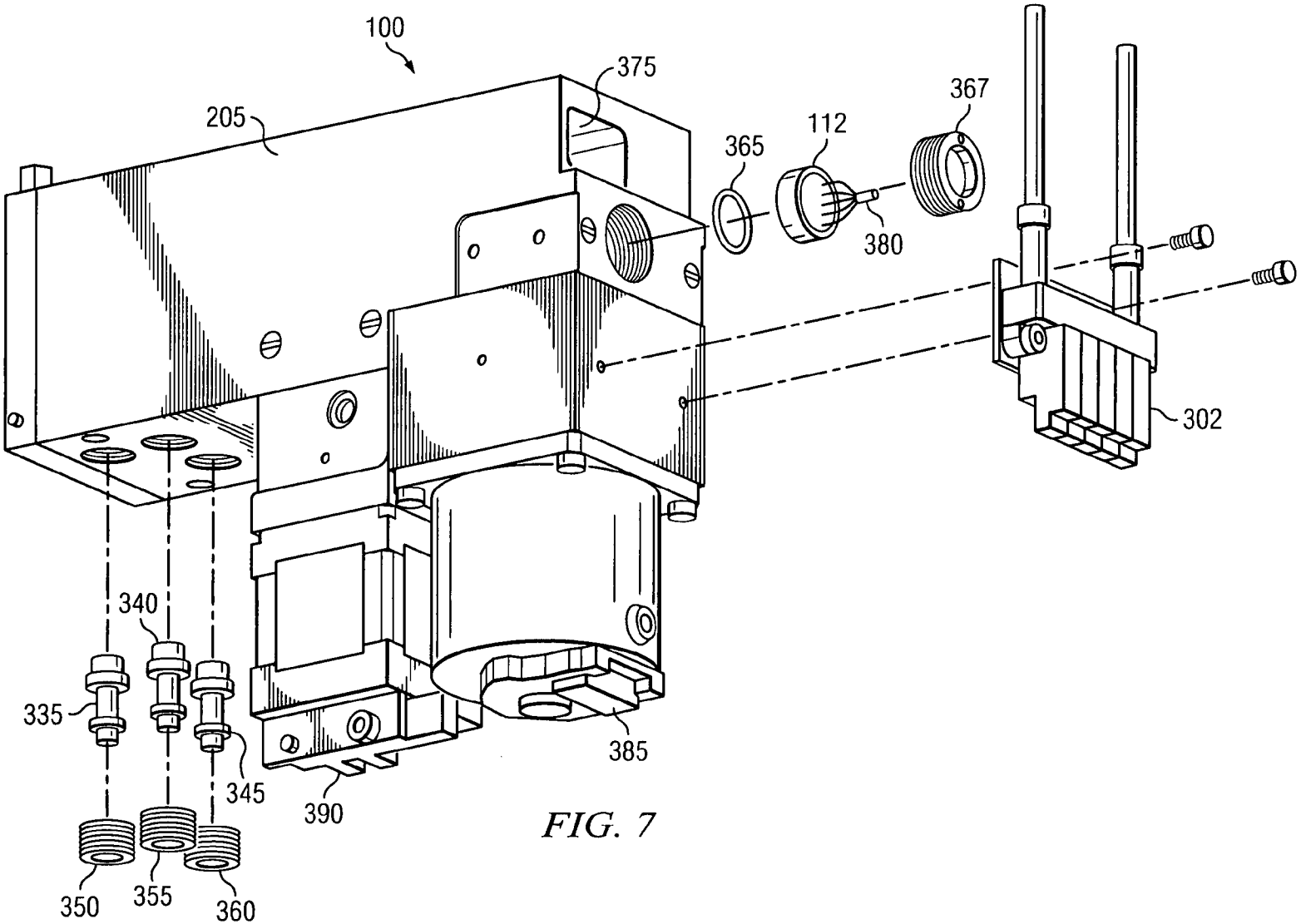
FIG. 7 is a diagrammatic representation of another embodiment of a partial assembly of a multi-stage pump.

FIG. 7 is a diagrammatic representation further illustrating a partial assembly of one embodiment of multi-stage pump 100. FIG. 7 illustrates adding filter fittings 335, 340 and 345 to dispense block 205. Nuts 350, 355, 360 can be used to hold filter fittings 335, 340, 345. It should be noted that any suitable fitting can be used and the fittings illustrated are provided by way of example. Each filter fitting leads to one of the flow passage to feed chamber, the vent outlet or dispense chamber (all via valve plate 230). Pressure sensor 112 can be inserted into dispense block 205, with the pressure sensing face exposed to dispense chamber 185. An o-ring 365 seals the interface of pressure sensor 112 with dispense chamber 185. Pressure sensor 112 is held securely in place by nut 310. Valve control manifold 302 can be screwed to piston housing 227. The valve control lines (not shown) run from the outlet of valve control manifold 302 into dispense block 205 at opening 375 and out the top of dispense block 205 to valve plate 230 (as shown in FIG. 4).

FIG. 7 also illustrates several interfaces for communications with a pump controller (e.g., pump controller 20 of FIG. 1). Pressure sensor 112 communicates pressure readings to controller 20 via one or more wires (represented at 380). Dispense motor 200 includes a motor control interface 205 to receive signals from pump controller 20 to cause dispense motor 200 to move. Additionally, dispense motor 200 can communicate information to pump controller 20 including position information (e.g., from a position line encoder). Similarly, feed motor 175 can include a communications interface 390 to receive control signals from and communicate information to pump controller 20.

Figure 8A:
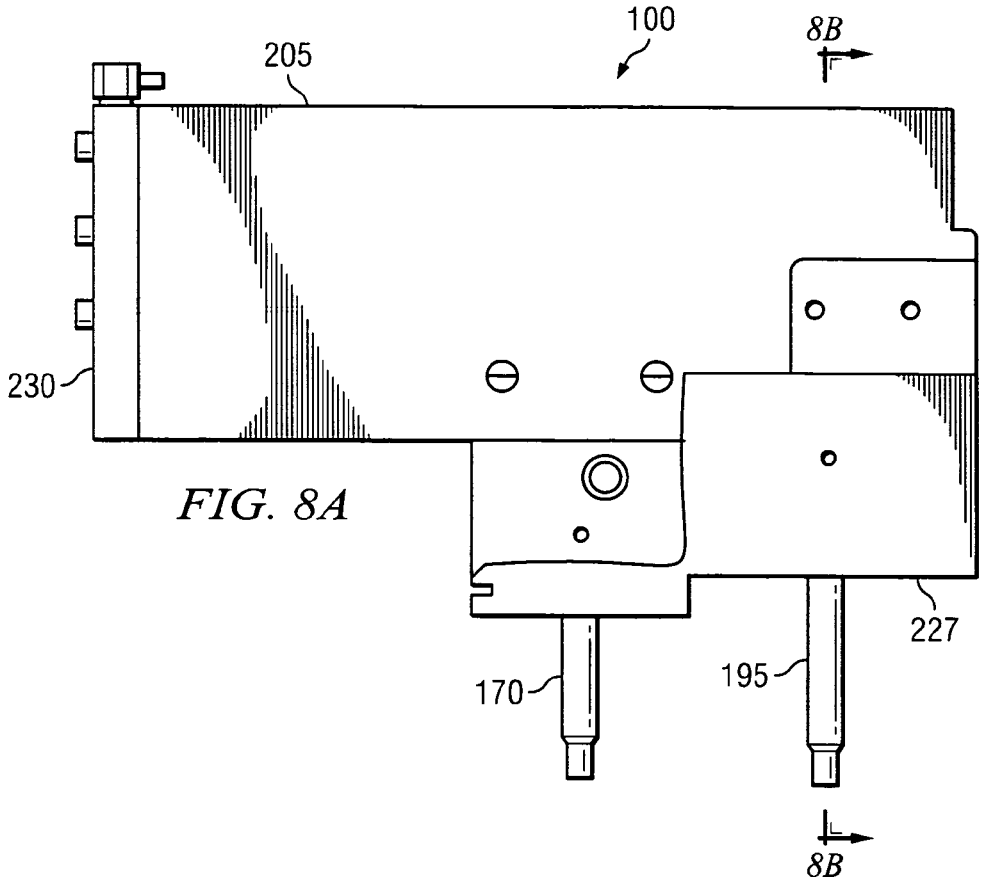
FIGS. 8A is a diagrammatic representation of one embodiment of a portion of a multi-stage pump.
Figure 8B:
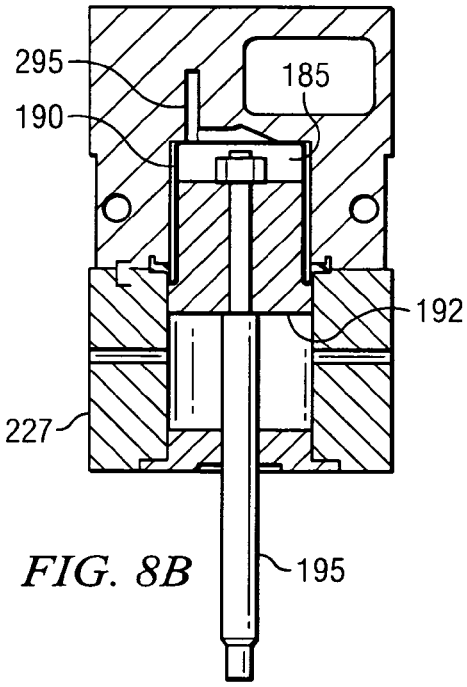
FIG. 8B is diagrammatic representation of section A-A of the embodiment of multi-stage pump of FIG. 8A.
Figure 8C:
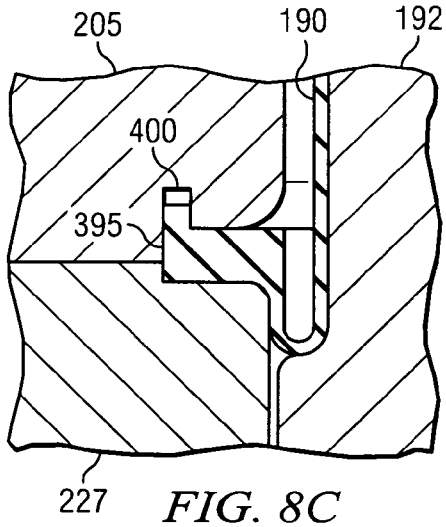
FIG. 8C is a diagrammatic representation of section B of the embodiment of multi-stage pump of FIG. 8B.

FIG. 8A illustrates a side view of a portion of multi-stage pump 100 including dispense block 205, valve plate 230, piston housing 227, lead screw 170 and lead screw 195. FIG. 8B illustrates a section view A-A of FIG. 8A showing dispense block 205, dispense chamber 185, piston housing 227, lead screw 195, piston 192 and dispense diaphragm 190. As shown in FIG. 8B, dispense chamber 185 can be at least partially defined by dispense block 205. As lead screw 195 rotates, piston 192 can move up (relative to the alignment shown in FIG. 8B) to displace dispense diaphragm 190, thereby causing fluid in dispense chamber 185 to exit the chamber via outlet flow passage 295. FIG. 8C illustrates detail B of FIG. 8B. In the embodiment shown in FIG. 8C, dispense diaphragm 190 includes a tong 395 that fits into a grove 400 in dispense block 200. The edge of dispense diaphragm 190, in this embodiment, is thus sealed between piston housing 227 and dispense block 205. According to one embodiment, dispense pump and/or feed pump 150 can be a rolling diaphragm pump.

It should be noted that the multi-stage pump 100 described in conjunction with FIGS. 1-8C is provided by way of example, but not limitation, and embodiments of the present invention can be implemented for other multi-stage pump configurations.

Figure 9:
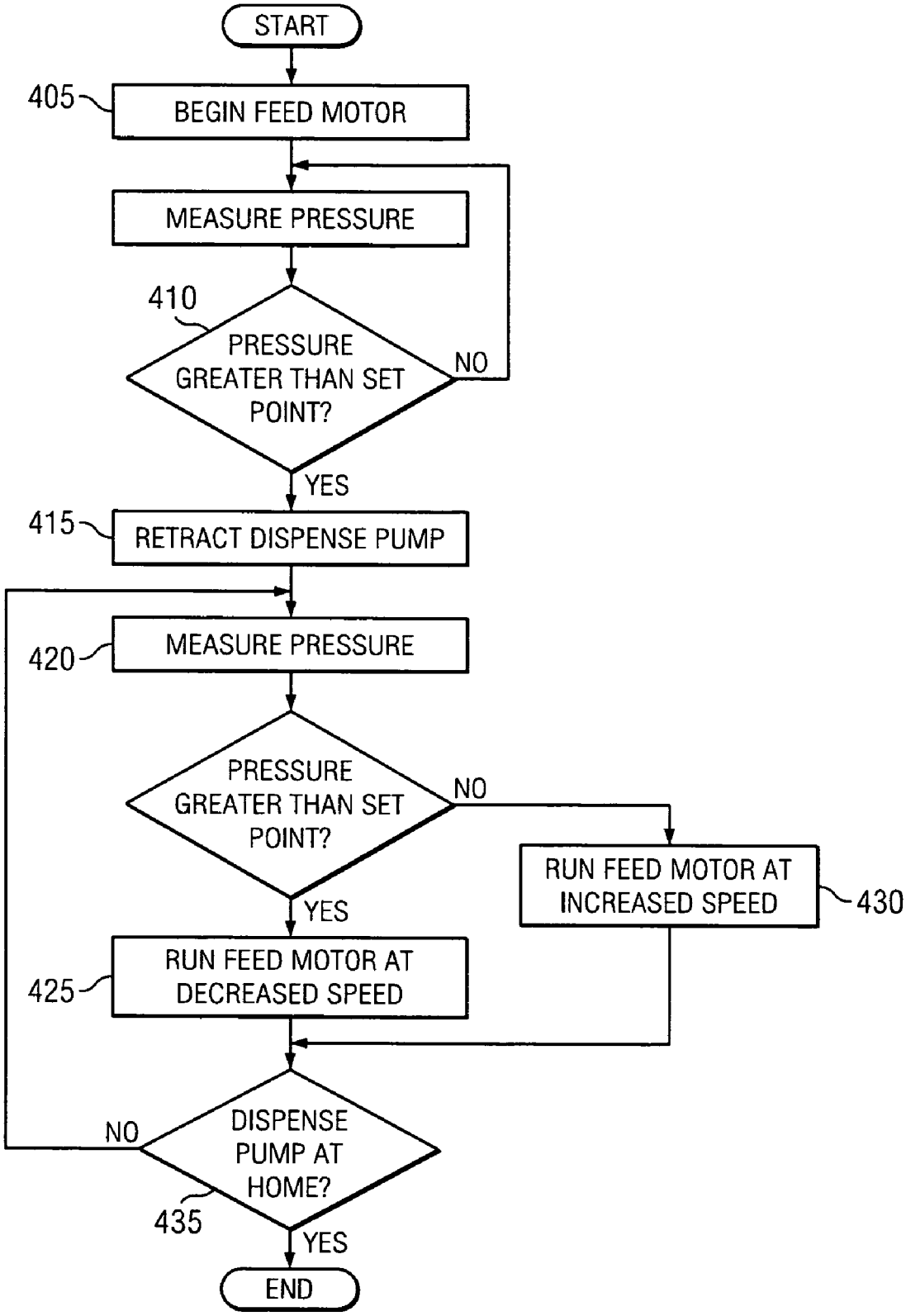
FIG. 9 is a flow chart illustrating one embodiment of a method for controlling pressure in a multi-stage pump.

As described above, embodiments of the present invention can provide for pressure control during the filtration segment of operation of a multi-stage pump (e.g., multi-stage pump 100). FIG. 9 is a flow chart illustrating one embodiment of a method for controlling pressure during the filtration segment. The methodology of FIG. 9 can be implemented using software instructions stored on a computer readable medium that are executable by a processor to control a multi-stage pump. At the beginning of the filtration segment, motor 175 begins to push fluid out of feed chamber 155 at a predetermined rate (step 405), causing fluid to enter dispense chamber 185. When the pressure in dispense chamber 185 reaches a predefined set point (as determined by pressure sensor 112 at step 410), the dispense motor begins to move to retract piston 192 and diaphragm 190 (step 415). The dispense motor, according to one embodiment, can be retract piston 165 at a predefined rate. Thus, dispense pump 180 makes more volume available for fluid in dispense chamber 185, thereby causing the pressure of the fluid to decrease.

Pressure sensor 112 continually monitors the pressure of fluid in dispense chamber 185 (step 420). If the pressure is at or above the set point, feed stage motor 175 operates at a decreased speed (step 425), otherwise feed motor 175 operates at an increased speed (step 430). The process of increasing and decreasing the speed of feed stage motor 175 based on the real-time pressure at dispense chamber 185 can be continued until dispense pump 180 reaches a home position (as determined at step 435). When dispense pump 180 reaches the home position, feed stage motor 175 and dispense stage motor 200 can be stopped.

Whether dispense pump 180 has reached its home position can be determined in a variety of manners. For example, as discussed in U.S. Provisional Patent Application No. 60/630,384, entitled "System and Method for a Variable Home Position Dispense System", filed Nov. 23, 2004, by Laverdiere et al., and PCT Patent Application No. PCT/US2005/042127, entitled, "System and Method for a Variable Home Position Dispense System", by Laverdiere et al., filed Nov. 21, 2005, which are hereby fully incorporated herein by reference, this can be done with a position sensor to determine the position of lead screw 195 and hence diaphragm 190. In other embodiments, dispense stage motor 200 can be a stepper motor. In this case, whether dispense pump 180 is in its home position can be determined by counting steps of the motor since each step will displace diaphragm 190 a particular amount. The steps of FIG. 9 can be repeated as needed or desired.

Figure 10:
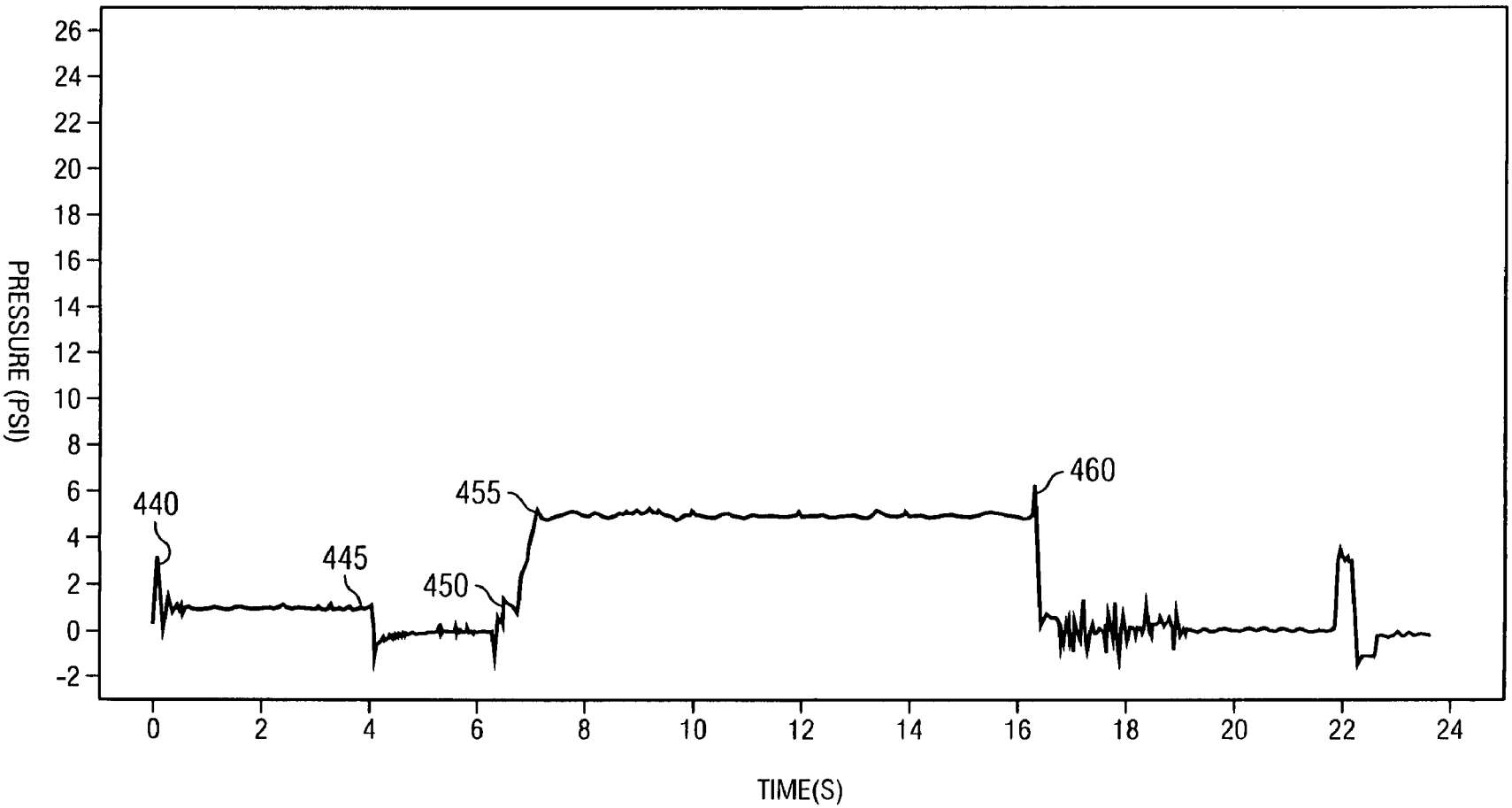
FIG. 10 is a pressure profile of a multi-stage pump according to one embodiment of the present invention.

FIG. 10 illustrates a pressure profile at dispense chamber 185 for operating a multi-stage pump according to one embodiment of the present invention. At point 440, a dispense is begun and dispense pump 180 pushes fluid out the outlet. The dispense ends at point 445. The pressure at dispense chamber 185 remains fairly constant during the fill segment as dispense pump 180 is not typically involved in this segment. At point 450, the filtration segment begins and feed stage motor 175 goes forward at a predefined rate to push fluid from feed chamber 155. As can be seen in FIG. 10, the pressure in dispense chamber 185 begins to rise to reach a predefined set point at point 455. When the pressure in dispense chamber 185 reaches the set point, dispense motor 200 reverses at a constant rate to increase the available volume in dispense chamber 185. In the relatively flat portion of the pressure profile between point 455 and point 460, the speed of feed motor 175 is increased whenever the pressure drops below the set point and decreased when the set point is reached. This keeps the pressure in dispense chamber 185 at an approximately constant pressure. At point 460, dispense motor 200 reaches its home position and the filtration segment ends. The sharp pressure spike at point 460 is caused by the closing of barrier valve 135 at the end of filtration.

Figure 11:
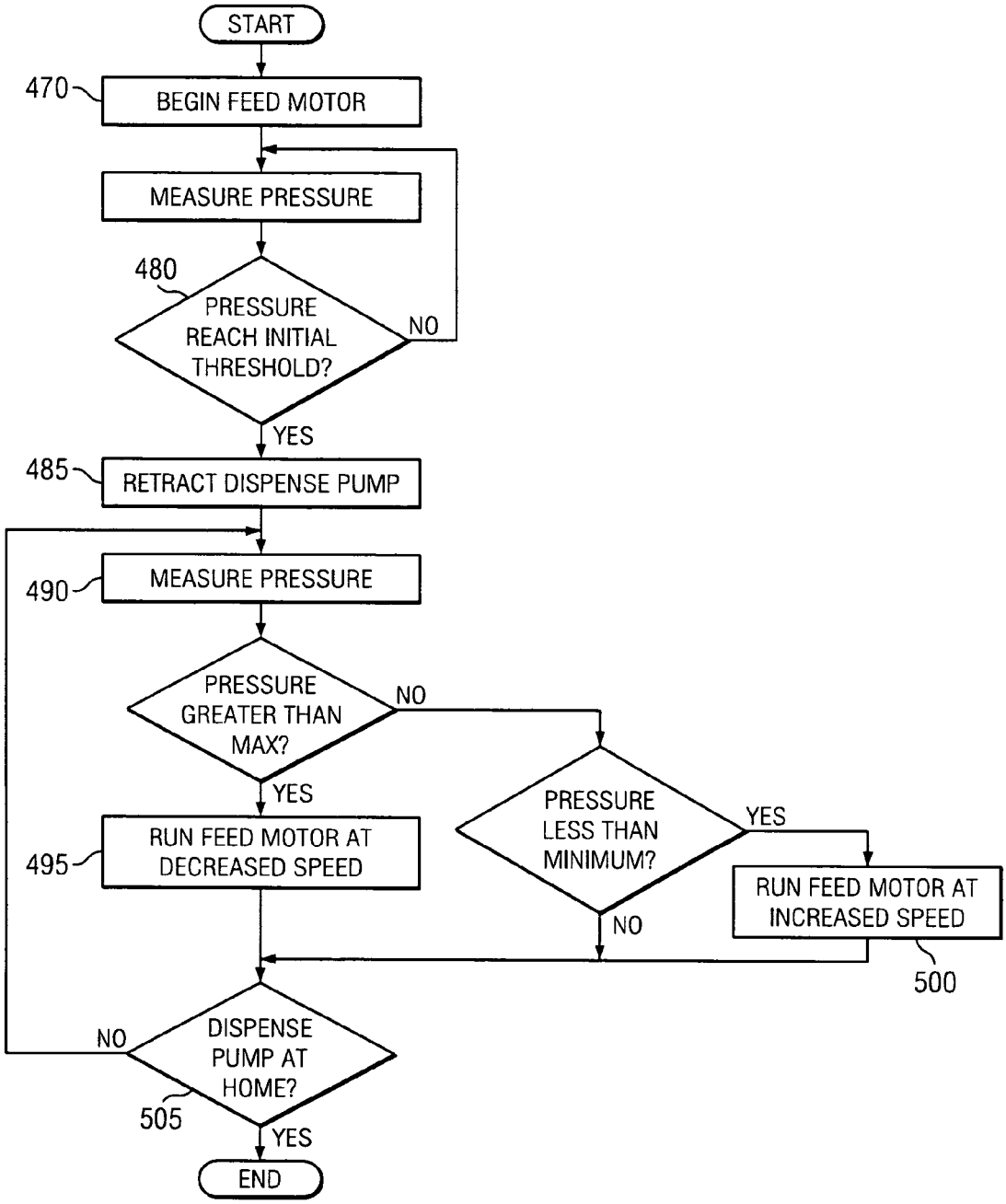
FIG. 11 is a flow chart illustrating another embodiment of a method for controlling pressure in a multi-stage pump.

The control scheme described in conjunction with FIG. 9 and 10 uses a single set point. However, in other embodiments of the present invention, a minimum and maximum pressure threshold can be used. FIG. 11 is a flow chart illustrating one embodiment of a method using minimum and maximum pressure thresholds. The methodology of FIG. 11 can be implemented using software instructions stored on a computer readable medium that are executable by a processor to control a multi-stage pump. At the beginning of the filtration segment, motor 175 begins to push fluid out of feed chamber 155 at a predetermined rate (step 470), causing fluid to enter dispense chamber 185. When the pressure in dispense chamber 185 reaches an initial threshold (as determined by measurements from pressure sensor 112 at step 480), the dispense motor begins to move to retract piston 192 and diaphragm 190 (step 485). This initial threshold can be the same as or different than either of the maximum or minimum thresholds. The dispense motor, according to one embodiment, retracts piston 165 at a predefined rate. Thus, dispense pump 180 retracts making more volume available for fluid in dispense chamber 185, thereby causing the pressure of the fluid to decrease.

Pressure sensor 112 continually monitors the pressure of fluid in dispense chamber 185 (step 490). If the pressure reaches the maximum pressure threshold, feed stage motor 175 operates at a determined speed (step 495). If the pressure falls below the minimum pressure threshold, feed stage motor 175 operates at an increased speed (step 500). The process of increasing and decreasing the speed of feed stage motor 175 based on the pressure at dispense chamber 185 can be continued until dispense pump 180 reaches a home position (as determined at step 505). When dispense pump 180 reaches the home position, feed stage motor 175 and dispense stage motor 200 can be stopped. Again, the steps of FIG. 11 can be repeated as needed or desired.

Embodiments of the present invention thus provide a mechanism to control the pressure at dispense pump 180 by controlling the pressure asserted on the fluid by the feed pump. When the pressure at dispense pump 180 reaches a predefined threshold (e.g., a set point or maximum pressure threshold) the speed of feed stage pump 150 can be reduced. When the pressure at dispense pump 180 falls below a predefined threshold (e.g., the set point or minimum pressure threshold) the speed of feed stage pump 150 can be increased. According to one embodiment of the present invention, feed stage motor 175 can cycle between predefined speeds depending on the pressure at dispense chamber 185. In other embodiments, the speed of feed stage motor 175 can be continually decreased if the pressure in dispense chamber 185 is above the predefined threshold (e.g., set point or maximum pressure threshold) and continually increased if the pressure in dispense chamber 185 falls below a predefined threshold (e.g., the set point or a minimum pressure threshold).

Figure 12:
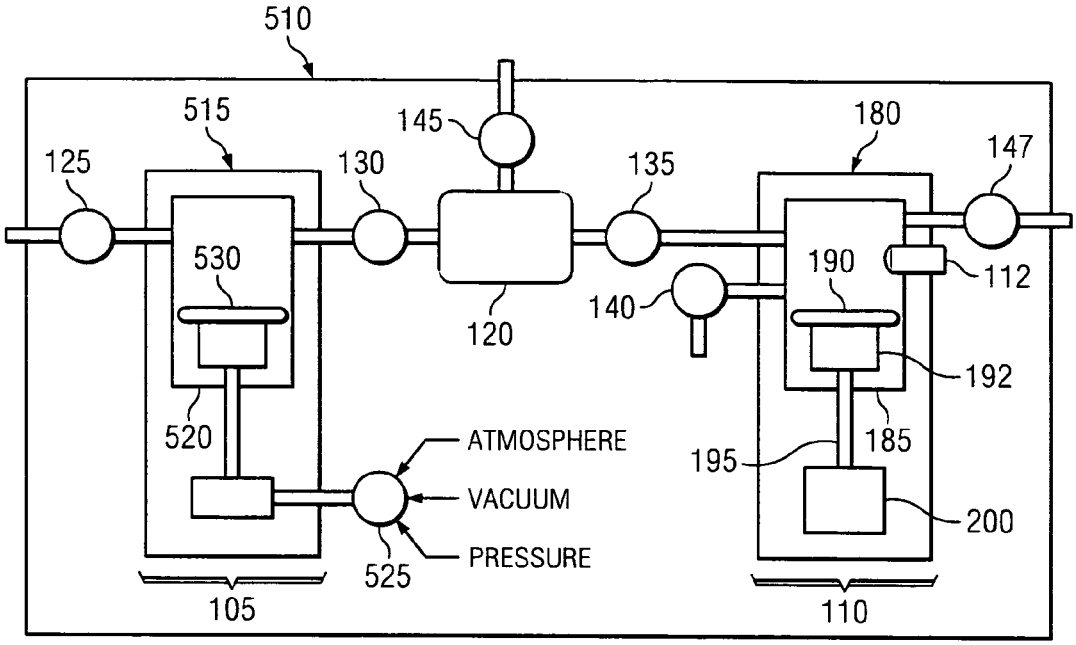
FIG. 12 is a diagrammatic representation of another embodiment of a multi-stage pump.

As described above, multi-stage pump 100 includes feed pump 150 with a motor 175 (e.g., a stepper motor, brushless DC motor or other motor) that can change speed depending on the pressure at dispense chamber 185. According to another embodiment of the present invention, the feed stage pump can be a pneumatically actuated diaphragm pump. FIG. 12 is a diagrammatic representation of one embodiment of a multi-stage pump 510 that includes a pneumatic feed pump 515. As with multi-stage pump 100, multi-stage pump 515 includes a feed stage portion 105 and a separate dispense stage portion 110. Located between feed stage portion 105 and dispense stage portion 110, from a fluid flow perspective, is filter 120 to filter impurities from the process fluid. A number of valves can control fluid flow through multi-stage pump 100 including, for example, inlet valve 125, isolation valve 130, barrier valve 135, purge valve 140, vent valve 145 and outlet valve 147. Dispense stage portion 110 can include a pressure sensor 112 that determines the pressure of fluid at dispense stage 110. The pressure determined by pressure sensor 112 can be used to control the speed of the various pumps as described below.

Feed pump 515 includes a feed chamber 520 which may draw fluid from a fluid supply through an open inlet valve 125. To control entry of liquid into and out of feed chamber 520, a feed valve 525 controls whether a vacuum, a positive feed pressure or the atmosphere is applied to a feed diaphragm 530. According to one embodiment pressurized N2 can be used to provide feed pressure. To draw fluid into feed chamber 520, a vacuum is applied to diaphragm 530 so that the diaphragm is pulled against a wall of feed chamber 520. To push the fluid out of feed chamber 520, a feed pressure may be applied to diaphragm 530.

According to one embodiment, during the filtration segment, the pressure at dispense chamber 185 can be regulated by the selective application of feed pressure to diaphragm 530. At the start of filtration feed pressure is applied to feed diaphragm 530. This pressure continues to be applied until a predefined pressure threshold (e.g., an initial threshold, a set point or other predefined threshold) is reached at dispense chamber 185 (e.g., as determined by pressure sensor 112). When the initial threshold is met, motor 200 of dispense pump 180 begins retracting to provide more available volume for fluid in dispense chamber 185. Pressure sensor 112 can continually read the pressure in dispense chamber 185. If the fluid pressure exceeds a predefined threshold (e.g., maximum pressure threshold, set point or other threshold) the feed pressure at feed pump 515 can be removed or reduced. If the fluid pressure at dispense chamber 185 falls below a predefined threshold (e.g., minimum pressure threshold, set point or other predefined threshold), the feed pressure can be reasserted at feed pump 515.

Thus, embodiments of the present invention provide a system and method for regulating the pressure of a fluid during a filtration segment by adjusting the operation of a feed pump based on a pressure determined at a dispense pump. The operation of the feed pump can be altered by, for example, increasing or decreasing the speed of the feed pump motor, increasing or decreasing the feed pressure applied at the feed pump or otherwise adjusting the operation of the feed pump to cause an increase or decrease in the pressure of the downstream process fluid.

Embodiments of the present invention also provide for control of fluid pressure during the vent segment. Referring to FIG. 2, if barrier valve 135 remains open during the vent segment, pressure sensor 112 will determine the pressure of the fluid in dispense chamber 185, which will be affected by the pressure of fluid in filter 120. If the pressure exceeds a predefined threshold (e.g., a maximum pressure threshold or a set point) the speed of feed motor 175 can be reduced (or feed pressure reduced in the example of FIG. 12) and if the pressure drops to a predefined threshold (e.g., a minimum pressure threshold or set point), the speed of feed motor 175 can be increased (or feed pressure increased in the example of FIG. 12). According to another embodiment, a user can provide a vent rate (e.g., 0.05 cc/sec) and vent amount (e.g., 0.15 cc or 3 seconds) and feed motor can displace fluid at the appropriate rate for the specified amount of time.

As can be understood from the foregoing, one embodiment of the present invention provides a system for controlling pressure in a multiple stage pump that has a first stage pump (e.g., a feed pump) and a second stage pump (e.g., a dispense pump) with a pressure sensor to determine the pressure of a fluid at the second stage pump. A pump controller can regulate fluid pressure at the second stage pump by adjusting the operation of the first stage pump. The pump controller is coupled to the first stage pump, second stage pump and pressure sensor (i.e., is operable to communicate with the first stage pump, second stage pump and pressure sensor) and is operable to receive pressure measurements from the pressure sensor. If a pressure measurement from the pressure sensor indicates that the pressure at the second stage pump has reached a first predefined threshold (e.g., a set point, a maximum pressure threshold or other pressure threshold), the pump controller can cause the first stage pump to assert less pressure on the fluid (e.g., by slowing its motor speed, reducing a feed pressure or otherwise decreasing pressure on the fluid). If the pressure measurements indicate that the pressure at the second stage pump is below a threshold (e.g., the set point, a minimum pressure threshold or other threshold), the controller can cause the first stage pump to assert more pressure on the fluid (e.g., by increasing the first stage pump's motor speed or increasing feed pressure or otherwise increasing pressure on the fluid).

Another embodiment of the present invention includes a method for controlling fluid pressure of a dispense pump in multi-stage pump. The method can comprise applying pressure to a fluid at a feed pump, determining a fluid pressure at a dispense pump downstream of the feed pump, if the fluid pressure at the dispense pump reaches predefined maximum pressure threshold, decreasing pressure on the fluid at the feed pump or if the fluid pressure at the dispense pump is below a predefined minimum pressure threshold, increasing pressure on the fluid at the feed pump. It should be noted that the maximum and minimum pressure thresholds can both be a set point.

Yet another embodiment of the present invention comprises a computer program product for controlling a pump. The computer program product can comprise a set of computer instructions stored on one or more computer readable media. The instructions can be executable by one or more processors to receive pressure measurements from a pressure sensor, compare the pressure measurements to the first predefined threshold (a maximum pressure threshold, set point or other threshold) and, if a pressure measurement from the pressure sensor indicates that the pressure at the second stage pump has reached the first predefined threshold, direct the first stage pump to assert less pressure on the fluid by for example, directing a first stage pump to decrease motor speed, apply less feed pressure or otherwise decrease the pressure applied by the first stage pump on the fluid. Additionally, the computer program product can comprise instructions executable to direct the first pump to assert more pressure on the fluid if the pressure measurement from the pressure sensor indicates the pressure at the second pump has fallen below a second threshold.

Another embodiment of the present invention can include a multiple stage pump adapted for use in a semiconductor manufacturing process comprising a feed pump, a filter in fluid communication with the feed pump, a dispense pump in fluid communication with the filter, an isolation valve between the feed pump and the filter, a barrier valve between filter and the dispense pump, a pressure sensor to measure the pressure at the dispense pump and a controller connected to (i.e., operable to communicate with the feed pump, dispense pump, feed pump and pressure sensor). The feed pump further comprises a feed chamber, a feed diaphragm in the feed chamber, a feed piston in contact with the feed diaphragm to displace the feed diaphragm, a feed lead screw coupled to the feed piston and a feed motor coupled to the feed lead screw to impart rotation to the feed lead screw to cause the feed piston to move. The dispense pump further comprises a dispense chamber, a dispense diaphragm in the dispense chamber, a dispense piston in contact with the dispense diaphragm to displace the dispense diaphragm, a dispense lead crew coupled to the dispense piston to displace the dispense piston in the dispense chamber, a dispense lead screw coupled to the dispense piston, a dispense motor coupled to the dispense lead screw to impart rotation to the dispense lead screw to cause the dispense piston to move. The controller is operable to receive pressure measurements from the pressure sensor. When a pressure measurement indicate that the pressure of a fluid in the dispense chamber has initially reached a set point, the controller directs the dispense motor to operate at an approximately constant rate to retract the dispense piston. For a subsequent pressure measurement, the controller directs the feed motor to operate at a decreased speed if the subsequent pressure measurement indicates that the pressure of the fluid in the dispense chamber is below the set point and direct the feed motor to operate at an increased speed if the subsequent pressure measurement is above the set point.

While the above systems and methods for pumps provide for accurate and reliable dispense of fluid, occasionally variations in process timing or normal wear and tear on these pumps (e.g. stop valve malfunction, fluid tubing kink, nozzle clogged, air in the fluid path, etc.) may manifest themselves through improper operation of the pump. As discussed above, it is desirable to detect these impending failure conditions or improper operations. To accomplish this, according to one embodiment, the present invention provides a method for monitoring a pump, including verifying proper operation and detecting impending failure conditions of a pump. Specifically, embodiments of the present invention may confirm an accurate dispense of fluid from the pump or the proper operation of a filter within the pump, among other operating actions or conditions.

Figure 13:
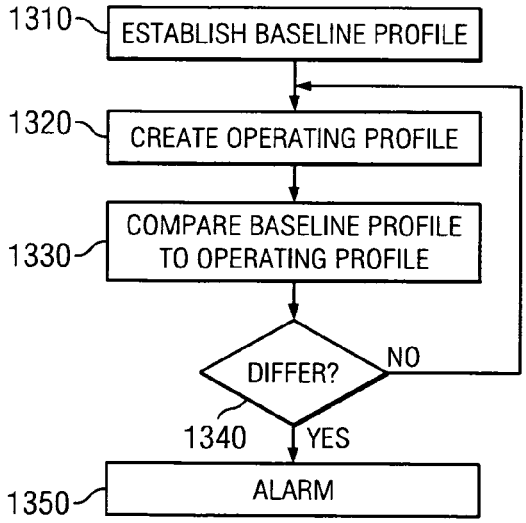
FIG. 13 is a flow diagram of one embodiment of a method according to the present invention.

FIG. 13 is a flow diagram depicting an embodiment of one such method for detecting improper operation (or conversely verifying proper operation, impending failure conditions, or almost anything else amiss in pumps, including embodiments of the pumps described above, one example of such a pump is the IG mini pump manufactured by Entegris Inc. More specifically, a baseline profile may be established for one or more parameters (step 1310). During operation of pump 100, then, these parameters may be measured to create an operating profile (step 1320). The baseline profile may then be compared with the operating profile at one or more corresponding points or portions (step 1330). If the operating profile differs from the baseline profile by more than a certain tolerance (step 1340) an alarm condition may exist (step 1350), otherwise pump 100 may continue operating.

To establish a baseline profile with respect to certain parameters (step 131b), a parameter may be measured during a baseline or "golden" run. In one embodiment, an operator or user of pump 100 may set up pump 100 to their specifications using liquid, conditions and equipment substantially similar, or identical, to the conditions and equipment with which pump 100 will be utilized during normal usage or operation of pump 100. Pump 100 will then be operated for a dispense cycle (as described above with respect to FIG. 3) to dispense fluid according to a user's recipe. During this dispense cycle the parameter may be measured substantially continuously, or at a set of points, to create an operating profile for that parameter. In one particular embodiment, the sampling of a parameter may occur at between approximately one millisecond and ten millisecond intervals.

The user may then verify that pump 100 was operating properly during this dispense cycle, and the dispense produced by pump 100 during this dispense cycle was within his tolerances or specifications. If the user is satisfied with both the pump operation and the dispense, he may indicate through pump controller 20 that it is desired that the operating profile (e.g. the measurements for the parameter taken during the dispense cycle) should be utilized as the baseline profile for the parameter. In this manner, a baseline profile for one or more parameters may be established FIG. 10 illustrates one embodiment of a pressure profile at dispense chamber 185 during operation of a multi-stage pump according to one embodiment of the present invention. It will be apparent after reading the above, that a baseline profile for each of one or more parameters may be established for each recipe in which the user desires to use pump 100, such that when pump 100 is used with this recipe the baseline profile(s) associated with this recipe may be utilized for any subsequent comparisons.

While a baseline profile for a parameter may be established by a user, other methods may also be used for establishing a baseline profile (step 1310). For example, a baseline profile for one or more parameters may also be created and stored in pump controller 20 during calibration of pump 100 by manufacturer of pump 100 using a test bed similar to that which will be utilized by a user of pump 100. A baseline profile may also be established by utilizing an operating profile as the baseline profile, where the operating profile was saved while executing a dispense cycle using a particular recipe and no errors have been detected by controller 20 during that dispense cycle. In fact, in one embodiment, baseline profile may be updated regularly using a previously saved operating profile in which no errors have been detected by controller 20.

After a baseline profile is established for one or more parameters (step 1310), during operation of pump 100 each of these parameters may be monitored by pump controller 20 to create an operating profile corresponding to each of the one or more parameters(step 1320). Each of these operating profiles may then be stored by controller 20. Again, these operating profiles may be created, in one embodiment, by sampling a parameter at approximately between 1 millisecond and 10 millisecond intervals.

To detect various problems that may have occurred during operation of pump 100, an operating profile for a parameter created during operation of pump 100 may then be compared to a baseline profile corresponding to the same parameter (step 1330). These comparisons may be made by controller 20, and, as may be imagined, this comparison can take a variety of forms. For example, the value of the parameter at one or more points of the baseline profile may be compared with the value of the parameter at substantially equivalent points in the operating profile; the average value of the baseline profile may be compared with the average value of the operating profile; the average value of the parameter during a portion of the baseline profile may be compared with the average value of the parameter during substantially the same portion in the operation profile; etc.

It will be understood that the type of comparisons described are exemplary only, and that any suitable comparison between the baseline profile and an operating profile may be utilized. In fact, in many cases, more than one comparison, or type of comparison, may be utilized to determine if a particular problem or condition has occurred. It will also be understood that the type(s) of comparison utilized may depend, at least in part, on the condition attempting to be detected. Similarly, the point(s), or portions, of the operational and baseline profiles compared may also depend on the condition attempting to be detected, among other factor. Additionally, it will be realized that the comparisons utilized may be made substantially in real time during operation of a pump during a particular dispense cycle, or after the completion of a particular dispense cycle.

If the comparison results in a difference outside of a certain tolerance (step 1340) an alarm may be registered at controller 20 (step 1350). This alarm may be indicated by controller 20, or the alarm may be sent to a tool controller interfacing with controller 20. As with the type of comparison discussed above, the particular tolerance utilized with a given comparison may be dependent on a wide variety of factors, for example, the point(s), or portions, of the profiles at which the comparison takes place, the process or recipe with which the user will use pump 100, the type of fluid being dispensed by pump 100, the parameter(s) being utilized, the condition or problem it is desired to detect, user's desire or user tuning of the tolerance, etc. For example, a tolerance may be a percentage of the value of the parameter at the comparison point of the baseline profile or a set number, the tolerance may be different when comparing a baseline profile with an operating profile depending on the point (or portion) of comparison, there may be a different tolerance if the value of the operating profile at a comparison point is lower than the value of the parameter at the comparison point of the baseline profile than if it is above the value, etc.

The description of embodiments of the systems and methods presented above may be better understood with reference to specific embodiments. As mentioned previously, it may be highly desirable to confirm that an accurate dispense of fluid has taken place. During the dispense segment of pump 100, outlet valve 147 opens and dispense pump 180 applies pressure to the fluid in dispense chamber 185. Because outlet valve 147 may react to controls more slowly than dispense pump 180, outlet valve 147 can be opened first and some predetermined period of time later dispense motor 200 started. This prevents dispense pump 180 from pushing fluid through a partially opened outlet valve 147. Moreover, this prevents fluid moving up the dispense nozzle caused by the valve opening, followed by forward fluid motion caused by motor action. In other embodiments, outlet valve 147 can be opened and dispense begun by dispense pump 180 simultaneously.

Because an improper dispense may be caused by improper timing of the activation of dispense motor 210 and/or the timing of outlet valve 147, in many cases, an improper dispense may manifest itself in the pressure in dispense chamber 185 during the dispense segment of pump 100. For example, suppose a blockage of outlet valve 147 occurred, or outlet valve 147 was delayed in opening. These conditions would cause a spike in pressure during the beginning of a dispense segment, or consistently higher pressure throughout the dispense segment as dispense motor 222 attempts to force fluid through outlet valve 147. Similarly, a premature closing of outlet valve 147 might also cause a pressure spike at the end of a dispense segment.

Thus, in one embodiment, in order to confirm that an acceptable dispense has occurred, or to detect problems with a dispense of fluid from pump 100, a baseline profile may be created (step 1310) using the parameter of pressure in dispense chamber 185 during a dispense cycle. Pressure in dispense chamber 185 during a subsequent dispense cycle may then be monitored using pressure sensor 112 to create an operating profile (step 1320). This operating profile may then be compared (step 1330) to the baseline profile to determine if an alarm should be sounded (step 1350).

As discussed above, an improper dispense may manifest itself through pressure variations in dispense chamber 185 during a dispense segment of operation of pump 100. More. specifically, however, due to the nature of the causes of improper dispense these pressure variations may be more prevalent as certain points during a dispense segment. Thus, in one embodiment, when comparing the baseline pressure profile and operating pressure profile (step 1330) four comparisons may be made. The first comparison may be the comparison of the average value of the pressure during the dispense segment according to the baseline profile with the average value of the pressure during the dispense segment according to the operating profile. This comparison may serve to detect any sort of sudden blockage that may occur during a dispense segment.

The second comparison may be of the pressure values at a point near the beginning of the dispense time.

For example, the value of the pressure at one or more points around 15% through the dispense segment on the baseline profile may be compared with the value of the pressure at substantially the same points in the dispense segment of the operating profile. This comparison may serve to detect a flow restriction caused by improper actuation of valves during the beginning of a dispense.

The third comparison may be of the pressure values at a point near the middle of the dispense segment. For example, the value of the pressure at one or more points around 50% through the dispense segment on the baseline profile may be compared with the value of the pressure at substantially the same points in the dispense segment of the operating profile.

The last comparison may be of the pressure values at a point near the end of the dispense segment. For example, the value of the pressure at one or more points around 90% through the dispense segment on the baseline profile may be compared with the value of the pressure at substantially the same point in the dispense segment of the operating profile. This comparison may serve to detect a flow restriction caused by improper actuation of valves during the ending portion of the dispense segment.

Figure 14:
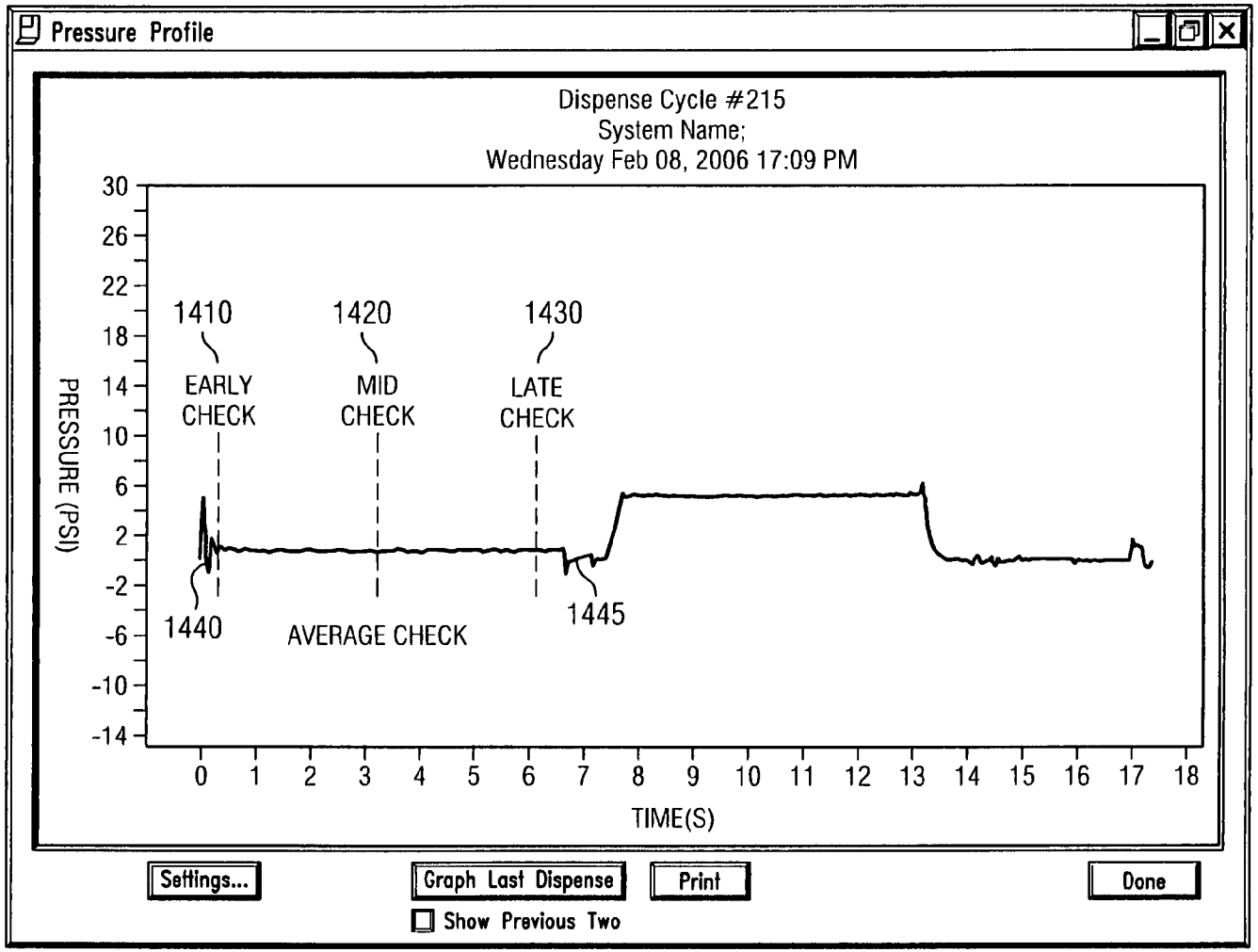
FIG. 14 is a pressure profile of a multi-stage pump according to one embodiment of the present invention.

The various comparisons (step 1330) involved in certain embodiments may be better understood with reference to FIG. 14, which illustrates one embodiment of a pressure profile at dispense chamber 185 during operation of a multi-stage pump according to one embodiment of the present invention. At approximately point 1440, a dispense segment is begun and dispense pump 180 pushes fluid out the outlet. The dispense segment ends at approximately point 1445.

Thus, as discussed above, in one embodiment of the systems and methods of the present invention, when comparing a baseline pressure profile to an operating pressure profile a first comparison may be of the average value of pressure between approximately point 1440 and point 1445, a second comparison may be between the value of baseline pressure profile and the value of an operating pressure profile at approximately point 1410 approximately 15% through the dispense segment, a third comparison may be between the value of baseline pressure profile and the value of an operating pressure profile at approximately point 1420 approximately 50% through the dispense segment and a fourth comparison may be between the value of baseline pressure profile and the value of an operating pressure profile at approximately point 1430 approximately 90% through the dispense segment.

As mentioned above, the results of each of these comparisons may be compared to a tolerance (step 1340) to determine if an alarm should be raised (step 1350). Again, the particular tolerance utilized with a given comparison may be dependent on a wide variety of factors, as discussed above. However, in many cases when the parameter being utilized is pressure in dispense chamber 185 during a dispense segment there should be little discrepancy between the pressure during dispense segments. Consequently, the tolerance utilized in this case may be very small, for example between 0.01 and 0.5 PSI. In other words, if the value of the operating profile at a given point differs from the baseline pressure profile at substantially the same point by more than around 0.02 PSI an alarm may be raised (step 1350).

The comparison between a baseline pressure profile and an operating pressure profile may be better illustrated with reference to FIG. 15, which depicts a baseline pressure profile at dispense chamber 185 during operation of one embodiment of a multi-stage pump and an operating pressure profile at dispense chamber 185 during subsequent operation of the multi-stage pump. At approximately point 1540, a dispense segment is begun and dispense pump 180 pushes fluid out the outlet. The dispense segment ends at approximately point 1545. Notice that operating pressure profile 1550 differs markedly from baseline pressure profile 1560 during portions of the dispense segment, indicating a possible problem with the dispense that occurred during the dispense segment of operating pressure profile 1550. This possible problem may be detected using embodiment of the present invention, as described above.

Specifically, using the comparisons illustrated above a first comparison may be of the average value between approximately point 1540 and point 1545. As operating pressure profile 1550 differs from baseline pressure profile 1540 during the beginning and ending of the dispense segment, this comparison will yield a significant difference. A second comparison may be between the value of baseline pressure profile 1540 and the value of operating pressure profile 1550 at approximately point 1510 approximately 15% through the dispense segment. As can be seen, at point 1510 the value of operating pressure profile 1550 differs by about 1 PSI from the value of baseline pressure profile 1540. A second comparison may be between the value of baseline pressure profile 1540 and the value of operating pressure profile 1550 at approximately point 1520 approximately 50% through the dispense segment. As can be seen, at point 1520 the value of operating pressure profile 1550 may be approximately the same as the value of baseline pressure profile 1540. A third comparison may be between the value of baseline pressure profile 1540 and the value of operating pressure profile 1550 at approximately point 1530 approximately 90% through the dispense segment. As can be seen, at point 1530 the value of operating pressure profile 1550 differs from the value of baseline pressure profile 1540 by about 5 PSI. Thus, three of the four comparisons described above may result in a comparison that is outside a certain tolerance (step 1340).

Figure 15:
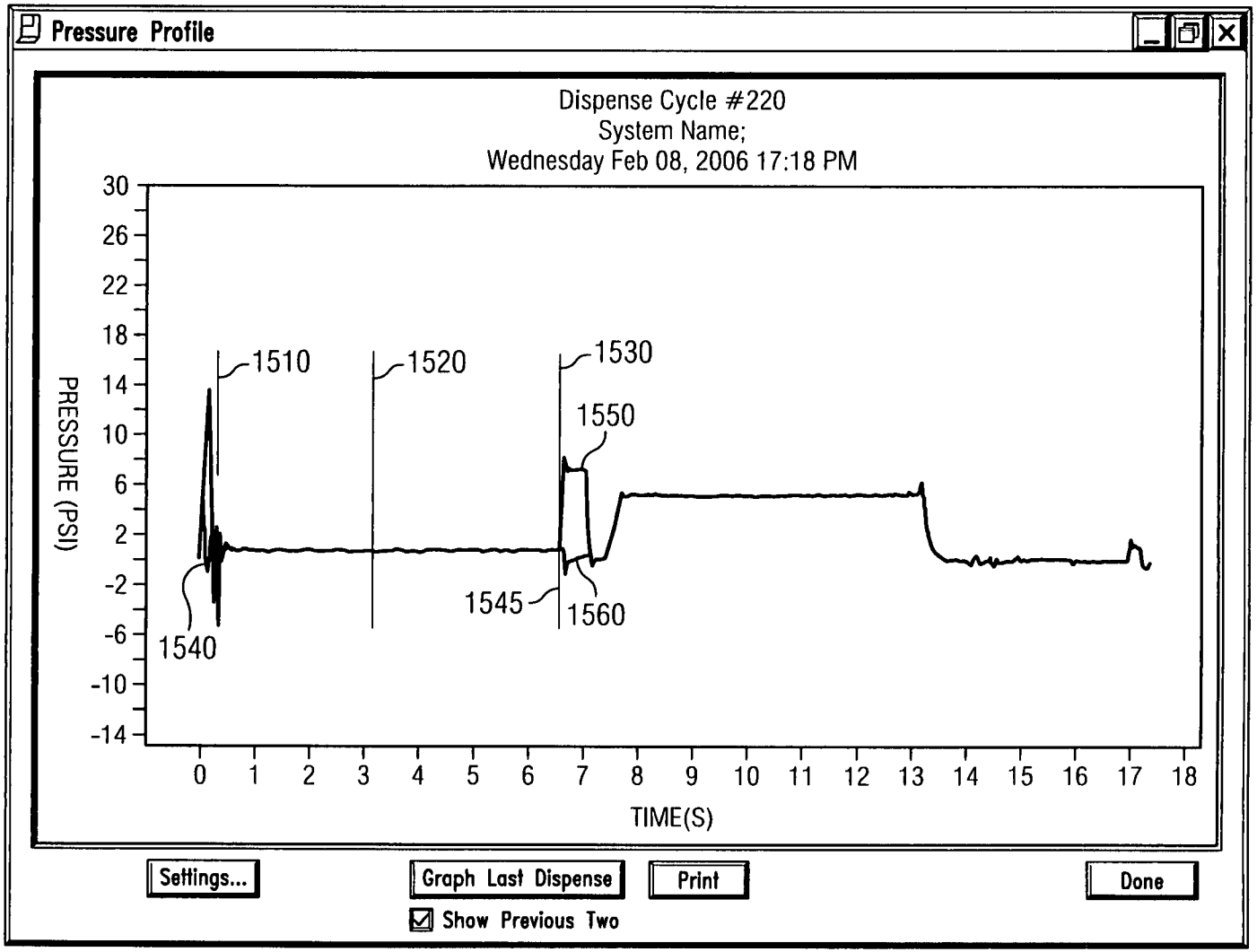
FIG. 15 is a baseline pressure profile of a multi-stage pump and an operating pressure profile of a multi-stage pump according to one embodiment of the present invention.

As a result, an alarm may be raised (step 1350) in the example depicted in FIG. 15. This alarm may alert a user to the discrepancy detected and serve to shut down pump 100. This alarm may be provided through controller 20, and may additionally present the user with the option to display either the baseline profile for the parameter, the operating profile for the parameter which caused an alarm to be raised, or the operating profile and the baseline profile together, for example superimposed on one another (as depicted in FIG. 15). In some instances a user may be forced to clear such an alarm before pump 100 will resume operation. By forcing a user to clear an alarm before pump 100 or the process may resume scrap may be prevented by forcing a user to ameliorate conditions which may cause scrap substantially immediately after they are detected or occur.

It may be helpful to illustrate the far ranging capabilities of the systems and methods of the present invention through the use of another example. During operation of pump 100 fluid passing through the flow path of pump 100 may be passed through filter 120 during one or more segments of operations, as described above. During one of these filter segments when the filter is new it may cause a negligible pressure drop across filter 120. However, through repeated operation of pump 100 filter 120 the pores of filter 120 may become clogged resulting in a greater resistance to flow through filter 120. Eventually the clogging of filter 120 may result in improper operation of pump 100 or damage to the fluid being dispensed. Thus, it would be desirable to detect the clogging of filter 120 before the clogging of filter 120 becomes problematic.

As mentioned above, according to one embodiment, during the filtration segment, the pressure at dispense chamber 185 can be regulated by the selective application of feed pressure to diaphragm 530. At the start of the filtration segment feed pressure is applied to feed diaphragm 530. This pressure continues to be applied until a predefined pressure threshold (e.g., an initial threshold, a set point or other predefined threshold) is reached at dispense chamber 185 (e.g., as determined by pressure sensor 112). When the initial threshold is met, motor 200 of dispense pump 180 begins retracting to provide more available volume for fluid in dispense chamber 185. Pressure sensor 112 can continually read the pressure in dispense chamber 185. If the fluid pressure exceeds a predefined threshold (e.g., maximum pressure threshold, set point or other threshold) the feed pressure at feed pump 515 can be removed or reduced. If the fluid pressure at dispense chamber 185 falls below a predefined threshold (e.g., minimum pressure threshold, set point or other predefined threshold), the feed pressure can be reasserted at feed pump 515.

Thus, embodiments of the present invention provide a system and method for regulating the pressure of a fluid during a filtration segment by adjusting the operation of a feed pump based on a pressure determined at a dispense pump. The operation of the feed pump can be altered by, for example, increasing or decreasing the speed of the feed pump motor, increasing or decreasing the feed pressure applied at the feed pump or otherwise adjusting the operation of the feed pump to cause an increase or decrease in the pressure of the downstream process fluid.

As can be seen from the above description then, as filter 120 becomes more clogged, and commensurately the pressure drop across filter 120 becomes greater, feed-stage motor 175 may need to operate more quickly, more often, or at a higher rate in order to maintain an equivalent pressure in dispense chamber 185 during a filter segment, or, in certain cases feed-stage motor 175 may not be able to maintain an equivalent pressure in dispense chamber at all (e.g. if a filter is completely clogged). By monitoring the speed of feed-stage motor 175 during a filter segment, then, clogging of filter 120 may be detected.

To that end, in one embodiment, in order to detect clogging of filter 120 a baseline profile may be created (step 1310) using the parameter of the speed of feed-stage motor 175 (or a signal to control the speed of feed-stage motor 175) during a filter segment when filter 120 is new (or at some other user determined point, etc.) and stored in controller 20. The speed of feed-stage motor 175 (or the signal to control the speed of feed-stage motor 175) during a subsequent filter segment may then be recorded by controller 20 to create an operating profile (step 1320). This feed-stage motor speed operating profile may then be compared (step 1330) to the feed-stage motor speed baseline profile to determine if an alarm should be sounded (step 1350).

In one embodiment, this comparison may take the form of comparing the value of the speed of the feed-stage motor at one or more points during the filter segments of the baseline profile with the value of the speed of the feed-stage motor at substantially the same set of points of the operating profile, while in other embodiments this comparison may compare what percentage of time during the baseline profile occurred within a certain distance of the control limits of feed-stage motor 175 and compare this with the percentage of time during the operating profile occurring within a certain distance of the control limits of feed-stage motor 175.

Similarly, air in filter 120 may detected by embodiments of the present invention. In one embodiment, during a pre-filtration segment feed-stage motor 175 continues to apply pressure until a predefined pressure threshold (e.g., an initial threshold, a set point or other predefined threshold) is reached at dispense chamber 185 (e.g., as determined by pressure sensor 112). If there is air in filter 120, the time it takes for the fluid to reach an initial pressure in dispense chamber 185 may take longer. For example, if filter 120 is fully primed it may take 100 steps of feed stage motor 175 and around 100 millisecond to reach 5 PSI in dispense chamber 185, however if air is present in filter 120 this time or number of step may increase markedly. As a result, by monitoring the time feed-stage motor 175 runs until the initial pressure threshold is reached in dispense chamber 185 during a pre-filtration segment air in filter 120 may be detected.

To that end, in one embodiment, in order to detect air in filter 120 a baseline profile may be created (step 1310) using the parameter of the time it takes to reach a setpoint pressure in dispense chamber 185 during a pre-filtration segment and stored in controller 20. The time it takes to reach a setpoint pressure in dispense chamber 185 during a subsequent pre-filtration segment may then be recorded by controller 20 to create an operating profile (step 1320). This time operating profile may then be compared (step 1330) to the time baseline profile to determine if an alarm should be sounded (step 1350).

Other embodiments of the invention may include verification of an accurate dispense through monitoring of the position of dispense motor 200. As elaborate on above, during the dispense segment, outlet valve 147 opens and dispense pump 180 applies pressure to the fluid in dispense chamber 185 until the dispense is complete. As can be seen then, at the beginning of the dispense segment the dispense motor 200 is in a first position while at the conclusion of the dispense segment dispense motor 200 may be in a second position.

In one embodiment, in order to confirm an accurate dispense a baseline profile may be created (step 1310) using the parameter of the position of dispense motor 200 (or a signal to control the position of feed-stage motor 200) during a dispense segment. The position of dispense motor 200 (or the signal to control the position of dispense motor 200) during a subsequent dispense segment may then be recorded by controller 20 to create an operating profile (step 1320). This dispense motor position operating profile may then be compared (step 1330) to the dispense motor position baseline profile to determine if an alarm should be sounded (step 1350).

Again, this comparison may take many forms depending on a variety of factors. In one embodiment, the value of the position of dispense motor 200 at the end of the dispense segment of the baseline profile may be compared with the value of the position of dispense motor 200 at the end of the dispense segment in the operating profile. In another embodiment, the value of the position of the dispense motor 200 according to the baseline profile may be compared to the value of the position of dispense motor 200 according the operating profile at a variety of points during the dispense segment.

Certain embodiments of the invention may also be useful for detecting impending failure of other various mechanical components of pump 100. For example, in many cases pumping system 10 may be a closed loop system, such that the current provided to dispense motor 200 to move motor 200 a certain distance may vary with the load on dispense motor 200. This property may be utilized to detect possible motor failure or other mechanical failures within pump 100, for example rolling piston or diaphragm issues, lead screw issues, etc.

In order to detect imminent motor failure, therefore, embodiments of the systems and methods of the present invention may create a baseline profile (step 1310) using the parameter of the current provided to dispense motor 200 (or a signal to control the current provided to dispense motor 200) during a dispense segment. The current provided to dispense motor 200 (or the signal to control the current provided to dispense motor 200) during a subsequent dispense segment may then be recorded by controller 20 to create an operating profile (step 1320). This dispense motor current operating profile may then be compared (step 1330) to the dispense motor position baseline profile to determine if an alarm should be sounded (step 1350).

While the systems and methods of the present invention has been described in detail with reference to the above embodiments, it will be understood that the systems and methods of the present invention may also encompass other wide and varied usage. For example, embodiments of the systems and methods of the present invention may be utilized to confirm the operation of a pump during a complete dispense cycle of a pump by recording a baseline profile corresponding to one or parameters for a dispense cycle and compare this to an operating profile created during a subsequent dispense cycle. By comparing the two profiles over an entire dispense cycle early detection of hardware failures or other problems may be accomplished.

Although the present invention has been described in detail herein with reference to the illustrative embodiments, it should be understood that the description is by way of example only and is not to be construed in a limiting sense. It is to be further understood, therefore, that numerous changes in the details of the embodiments of this invention and additional embodiments of this invention will be apparent to, and may be made by, persons of ordinary skill in the art having reference to this description. It is contemplated that all such changes and additional embodiments are within the scope of this invention as claimed below.

What is claimed is:

1. A method for controlling fluid pressure in a multiple stage pump comprising:

accessing a baseline pressure profile for a known good dispense cycle;

operating a feed pump, a dispense pump and a set of valves to perform a new dispense cycle including a fill segment and a dispense segment;

continually taking pressure measurements during the dispense cycle of fluid in a dispense chamber using a pressure sensor disposed to measure pressure in the dispense chamber;

creating a first operating profile from the pressure measurements taken during the new dispense cycle;

during one or more of the fill segment or the dispense segment of the new dispense cycle, comparing each of one or more values associated with the first operating profile with a corresponding value associated with the baseline profile to determine if each of the one or more values associated with the first operating profile is within a tolerance of the corresponding value associated with the baseline profile; and during one or more of the fill segment or the dispense segment, if the one or more values associated with the first operating profile is not within tolerances, generating an alarm;

wherein operating the feed pump, dispense pump and set of valves to perform the fill segment comprises:

operating the feed pump to reduce a volume of a feed chamber at a first predetermined rate;

opening a barrier valve to allow a fluid in the feed chamber to enter said dispense chamber while keeping an outlet valve closed so that none of the fluid entering the dispense chamber is dispensed;

taking pressure measurements of the fluid in the dispense chamber using the pressure sensor;

determining whether a first pressure measurement is greater than a predetermined pressure;

in response to the first pressure measurement being greater than said predetermined pressure, operating said dispense pump to increase a volume of the dispense chamber at a second predetermined rate;

taking a second pressure measurement while the dispense pump is operating to increase the volume of the dispense chamber;

determining whether the second pressure measurement is greater than a first threshold or less than a second threshold;

in response to determining that the second pressure measurement is greater than the first pressure threshold, operating the feed pump at a decreased speed;

in response to determining that the second pressure measurement is less than the second threshold, operating the feed pump at an increased speed;

determining whether the operation of the dispense pump has caused the volume of the dispense chamber to reach a predetermined volume;

in response to determining that the volume of the dispense chamber has not reached the predetermined volume, repeating the method from the step of measuring the second pressure; and in response to determining that the volume of the dispense chamber has reached the predetermined volume, stopping the operation of the feed pump and the dispense pump.

2. The method of claim 1, wherein the first threshold is the predetermined pressure.

3. The method of claim 2, wherein the second threshold is the predetermined pressure.

4. The method of claim 1, wherein the fluid has a viscosity of less than 5 centipoise.

5. The method of claim 1, further comprising;

closing the barrier valve;

opening the outlet valve; and operating the dispense pump to dispense fluid onto a wafer.

6. The method of claim 1, wherein operating the feed pump comprises operating a stepper motor.

7. The method of claim 6, wherein operating the dispense pump comprises operating a permanent-magnet synchronous motor.

8. The method of claim 1, further comprising filtering the fluid through a filter between the feed pump and the dispense pump.

9. A multiple stage pump comprising:

a feed pump comprising:

a feed chamber;

a first diaphragm movable in the feed chamber;

a first lead screw to move the first diaphragm;

a first motor coupled to the first lead screw to rotate the first lead screw;

a dispense pump fluidly coupled to the feed pump, the dispense pump comprising:

a dispense chamber;

a second diaphragm movable in the dispense chamber;

a second lead screw to move the second diaphragm;

a second motor coupled to the second lead screw to rotate the second lead screw;

a filter disposed in a fluid flow path between the feed pump and the dispense pump;

an inlet valve;

an isolation valve;

a barrier valve;

an outlet valve;

a pressure sensor positioned to measure pressure in said dispense chamber; and a pump controller comprising a processor and a tangible, non-transitory computer readable medium storing a set of instructions executable to cause the controller to:

access a baseline pressure profile for a known good dispense cycle;

operate the multiple stage pump to perform a new dispense cycle including a fill segment and a dispense segment;

continually take pressure measurements during the dispense cycle of fluid in said dispense chamber using the pressure sensor;

create a first operating profile from the pressure measurements taken during the new dispense cycle;

during one or more of the fill segment or the dispense segment of the new dispense cycle, compare each of one or more values associated with the first operating profile with a corresponding value associated with the baseline profile to determine if each of the one or more values associated with the first operating profile is within a tolerance of the corresponding value associated with the baseline profile; and during one or more of the fill segment or the dispense segment, if the one or more values associated with the first operating profile is not within tolerances, generating an alarm;

wherein operating the multi-stage pump to perform the fill segment comprises:

operating the feed pump to reduce a volume of said feed chamber at a first predetermined rate;

opening said barrier valve to allow a fluid in the feed chamber to enter said dispense chamber while keeping said outlet valve closed so that none of the fluid entering the dispense chamber is dispensed;

taking pressure measurements of the fluid in the dispense chamber using the pressure sensor;

determining whether a first pressure measurement is greater than a predetermined pressure;

in response to the first pressure measurement being greater than said predetermined pressure, operating a dispense pump to increase a volume of the dispense chamber at a second predetermined rate;

taking a second pressure measurement while the dispense pump is operating to increase the volume of the dispense chamber;

determining whether the second pressure measurement is greater than a first threshold or less than a second threshold;

in response to determining that the second pressure measurement is greater than the first pressure threshold, operating the feed pump at a decreased speed;

in response to determining that the second pressure measurement is less than the second threshold, operating the feed pump at an increased speed;

determining whether the operation of the dispense pump has caused the volume of the dispense chamber to reach a predetermined volume;

in response to determining that the volume of the dispense chamber has not reached the predetermined volume, repeating the method from the step of measuring the second pressure; and in response to determining that the volume of the dispense chamber has reached the predetermined volume, stopping the operation of the feed pump and the dispense pump.

10. The multiple stage pump of claim 9, wherein the fluid has a viscosity of less than 5 centipoise.

11. The multiple stage pump of claim 9, wherein:

the pump controller is further operable to:

close the barrier valve after the dispense chamber has reached the predetermined volume;

open the outlet valve; and operate the dispense pump to dispense fluid from the multiple stage pump.

12. The multiple stage pump of claim 9, wherein the first motor is a stepper motor.

13. The multiple stage pump of claim 12, wherein the second motor is a permanent-magnet synchronous motor.

14. The multiple stage pump of claim 9, wherein the first threshold is the predetermined pressure.

15. The multiple stage pump of claim 14, wherein the second threshold is the predetermined pressure.

16. A computer program product comprising a tangible, non-transitory computer readable medium storing instructions executable to perform a method of controlling a multiple stage pump, the method comprising:

accessing a baseline pressure profile for a known good dispense cycle;

operating a feed pump, a dispense pump and a set of valves to perform a new dispense cycle including a fill segment and a dispense segment;

continually taking pressure measurements during the dispense cycle of fluid in a dispense chamber using a pressure sensor disposed to measure pressure in the dispense chamber;

creating a first operating profile from the pressure measurements taken during the new dispense cycle;

during one or more of the fill segment or the dispense segment of the new dispense cycle, comparing each of one or more values associated with the first operating profile with a corresponding value associated with the baseline profile to determine if each of the one or more values associated with the first operating profile is within a tolerance of the corresponding value associated with the baseline profile; and during one or more of the fill segment or the dispense segment, if the one or more values associated with the first operating profile is not within tolerances, generating an alarm;

wherein operating the feed pump, dispense pump and set of valves to perform the fill segment comprises:

operating the feed pump to reduce a volume of a feed chamber at a first predetermined rate;

opening a barrier valve to allow a fluid in the feed chamber to enter said dispense chamber while keeping an outlet valve closed so that none of the fluid entering the dispense chamber is dispensed;

taking pressure measurements of the fluid in the dispense chamber using the pressure sensor;

determining whether a first pressure measurement is greater than a predetermined pressure;

in response to the first pressure measurement being greater than said predetermined pressure, operating said dispense pump to increase a volume of the dispense chamber at a second predetermined rate;

taking a second pressure measurement while the dispense pump is operating to increase the volume of the dispense chamber;

determining whether the second pressure measurement is greater than a first threshold or less than a second threshold;

in response to determining that the second pressure measurement is greater than the first pressure threshold, operating the feed pump at a decreased speed;

in response to determining that the second pressure measurement is less than the second threshold, operating the feed pump at an increased speed;

determining whether the operation of the dispense pump has caused the volume of the dispense chamber to reach a predetermined volume;

in response to determining that the volume of the dispense chamber has not reached the predetermined volume, repeating the method from the step of measuring the second pressure; and in response to determining that the volume of the dispense chamber has reached the predetermined volume, stopping the operation of the feed pump and the dispense pump.

17. The computer program product of claim 16, wherein the first threshold is the predetermined pressure.

18. The computer program product of claim 17, wherein the second threshold is the predetermined pressure.

19. The computer program product of claim 16, wherein operating the feed pump comprises operating a stepper motor.

20. The computer program product of claim 16, wherein operating the dispense pump comprises operating a permanent-magnet synchronous motor.

* * * * *